US009315362B2

(12) United States Patent
Felis et al.

(10) Patent No.: US 9,315,362 B2
(45) Date of Patent: Apr. 19, 2016

(54) SNAP-FIT ELEVATOR LANTERNS

(71) Applicant: ThyssenKrupp Elevator Corporation, Atlanta, GA (US)

(72) Inventors: Thomas Felis, Atlanta, GA (US); Anthony C. Douell, Blue Mountain, MS (US); Stephen A. Anderson, Thompsons Station, TN (US)

(73) Assignee: THYSSENKRUPP ELEVATOR CORPORATION, Atlanta, GA (US)

( * ) Notice: Subject to any disclaimer, the term of this patent is extended or adjusted under 35 U.S.C. 154(b) by 603 days.

(21) Appl. No.: 13/754,203

(22) Filed: Jan. 30, 2013

(65) Prior Publication Data

US 2014/0209416 A1 Jul. 31, 2014

(51) Int. Cl.

| | |
|---|---|
| ***B66B 1/34*** | (2006.01) |
| ***B66B 3/00*** | (2006.01) |
| ***B66B 1/46*** | (2006.01) |
| ***B66B 3/02*** | (2006.01) |

(52) U.S. Cl.

CPC ..... *B66B 3/004* (2013.01); *B66B 1/466* (2013.01); *B66B 3/002* (2013.01); *B66B 3/02* (2013.01)

(58) Field of Classification Search

CPC ..... B66B 1/466; B66B 3/02; B66B 3/002; B66B 3/004

USPC ..... 187/247, 391, 393, 395; 340/815.69, 340/815.7, 815.49, 815.73, 815.74, 815.76

See application file for complete search history.

(56) References Cited

U.S. PATENT DOCUMENTS

| | | | | | |
|---|---|---|---|---|---|
| 2,525,769 | A | * | 10/1950 | Bruns | B66B 1/462 174/371 |
| 3,952,837 | A | * | 4/1976 | Rice | B66B 3/00 187/380 |
| 4,032,774 | A | | 6/1977 | Spicer | |
| 4,635,167 | A | | 1/1987 | Schlosser | |
| 4,712,651 | A | | 12/1987 | Sherwood et al. | |
| 4,924,974 | A | | 5/1990 | Orndorff et al. | |
| 5,162,665 | A | | 11/1992 | Troyen | |
| 5,379,865 | A | * | 1/1995 | Berdich | B66B 3/00 187/395 |
| 5,400,988 | A | | 3/1995 | Achermann | |
| 5,433,295 | A | | 7/1995 | Murphy | |
| 5,460,118 | A | * | 10/1995 | Shea | B66B 3/00 116/226 |
| 5,490,581 | A | * | 2/1996 | Warner | H02B 1/26 187/395 |
| 5,565,661 | A | | 10/1996 | Berdich et al. | |

(Continued)

FOREIGN PATENT DOCUMENTS

| | | |
|---|---|---|
| FR | 2 659 636 | 9/1991 |
| KR | 20050116605(A) | 12/2005 |

OTHER PUBLICATIONS

Unitec Hall Lanterns Catalog, Jan. 2008.

(Continued)

*Primary Examiner* — Anthony Salata

(74) *Attorney, Agent, or Firm* — Frost Brown Todd LLC

(57) ABSTRACT

An elevator lantern apparatus uses a snap-fit assembly and disassembly configuration where the lantern apparatus includes components such as a tray, a lens, and a control board having one or more illuminating features. These components are configured to assemble through an opening in a surface such as a wall. In some versions, assembly and disassembly is done without the use of tools. In some versions, disassembly of the lantern apparatus is done from the front side of the lantern apparatus by removing the lens to access other components.

19 Claims, 31 Drawing Sheets

(56) References Cited

U.S. PATENT DOCUMENTS

| | | | | |
|---|---|---|---|---|
| 5,755,508 | A | 5/1998 | Wheaton | |
| 5,780,790 | A | 7/1998 | Benson | |
| 5,889,240 | A * | 3/1999 | Purosto | B66B 1/462 187/395 |
| 6,227,335 | B1 | 5/2001 | Koeppe, Jr. et al. | |
| 6,461,025 | B1 | 10/2002 | Payne | |
| 6,598,711 | B2 * | 7/2003 | Barmet | B66B 3/004 116/64 |
| 7,066,617 | B2 | 6/2006 | Mandy et al. | |
| 7,152,715 | B2 * | 12/2006 | Meyer | B66B 1/465 187/391 |
| 7,182,487 | B1 | 2/2007 | Pickard et al. | |
| 7,296,908 | B1 | 11/2007 | Pickard et al. | |
| 7,714,244 | B1 | 5/2010 | De Pedro | |
| 8,348,022 | B2 * | 1/2013 | Rusanen | B66B 1/461 187/391 |

OTHER PUBLICATIONS

International Search Report and Written Opinion dated Mar. 31, 2014 for Application No. PCT/US2013/076095.

Abstract and English Mahine Translation for French Patent No. FR 2 659 636.

* cited by examiner

SNAP-FIT ELEVATOR LANTERNS

BACKGROUND

Lanterns are used in elevator systems for a variety of reasons. For instance, lanterns may be used at elevator landings to indicate to a future passenger whether the elevator arriving at the elevator landing will go up or down. Furthermore, lanterns may illuminate or produce an audible signal that indicates to a passenger that an elevator car has arrived at the elevator landing. During the life of the elevator lantern, it will be appreciated that various components within the elevator lantern may require servicing, which may include repairing, upgrading, or periodically maintaining the various components within the lantern. In many existing systems, it may be challenging to reach the lantern and further to access the various parts within the lantern to service the lantern. In other instances, lanterns may only be installed in conjunction with a faceplate or wall plate, which may be large and cumbersome.

While a variety of lanterns have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
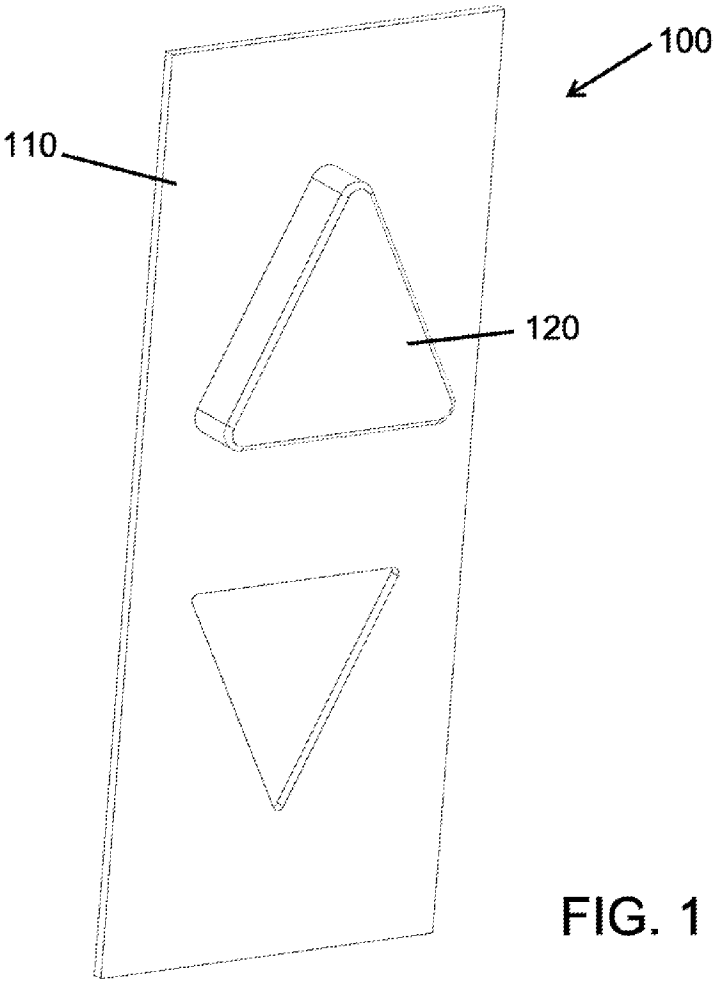
FIG. 1 depicts a perspective view of an exemplary elevator lantern system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

I. Exemplary Elevator Lantern

FIG. 1 shows an exemplary version of an elevator lantern, or elevator lantern system (100) for use with an elevator system. It will be appreciated that elevator lantern system (100) may be installed at elevator landings, or in some cases may even be installed on elevator cars. It will be understood that elevator lantern system (100) may be installed and used in any suitable part of an elevator system as would be apparent to one of ordinary skill in the art in view of the teachings herein.

Elevator lantern system (100) comprises an opening (114) in a surface (110), e.g., a wall surface, and a lens (120). Elevator lantern system (100) further comprises a tray (124) and a control board (130), which can be seen in FIG. 2, and which have various components which will be discussed in further detail below. While the versions described herein refer to the elevator lantern systems being installed in openings in wall surfaces, such lantern systems can also be installed in openings in other surfaces such as ceilings, floors, doors, or any other suitable mounting surface as will be apparent to those of ordinary skill in the art in view of the teachings herein. Accordingly, wall surfaces should be considered interchangeable with other terms like ceilings, floors, doors, or mounting surfaces generally. Also, for purposes of this description, surface (110) is understood to have a front side and a rear side. The front side generally being the side that faces the same direction as the closed surface of lens (120) that a passenger sees, and the rear side being the opposite side. These descriptors also apply to direction, with a forward direction being outward from the front side and away from the back side, and a rearward direction being outward from the rear side and away from the front side.

Figure 4:
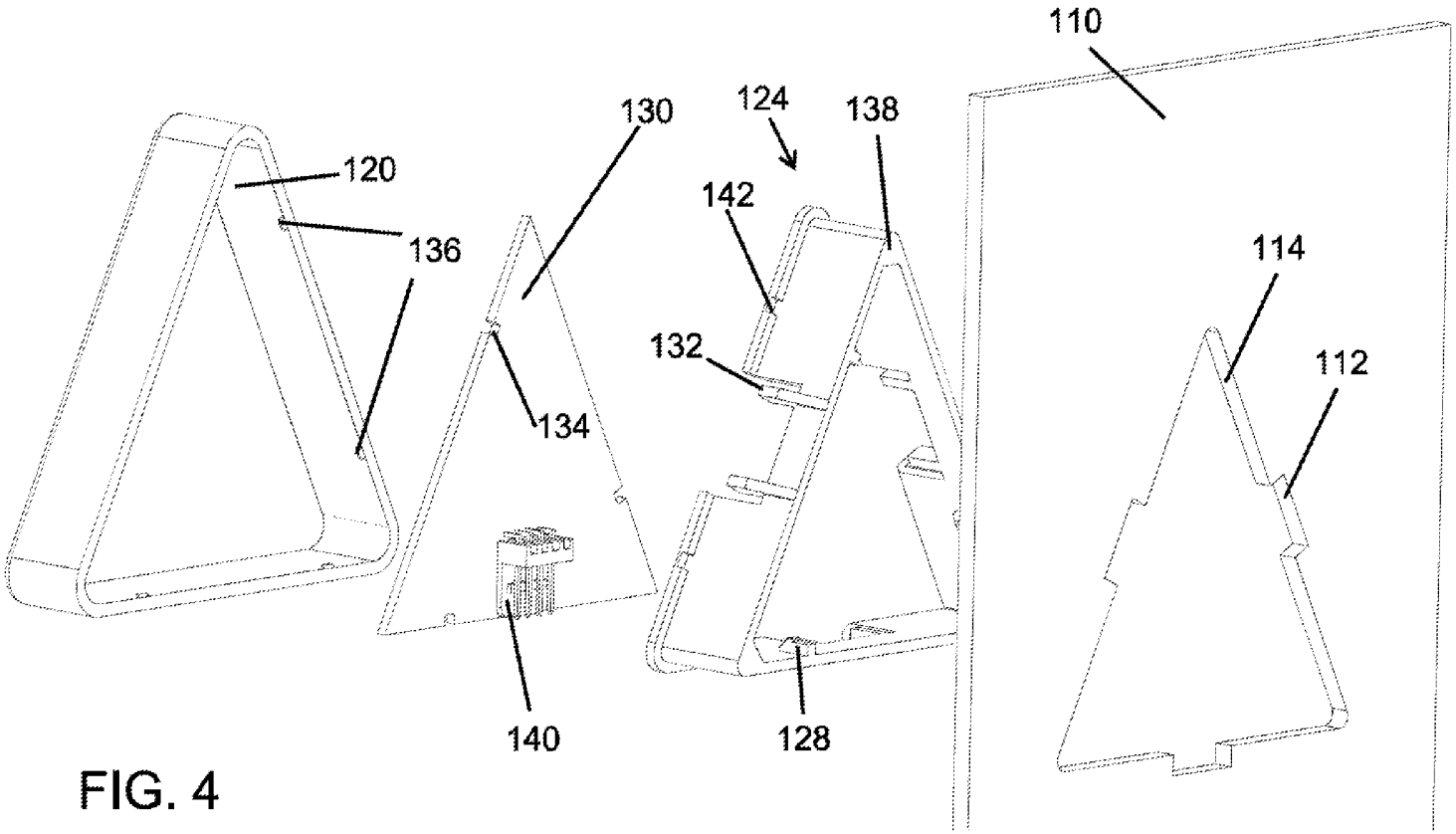
FIG. 4 depicts a rear, perspective, exploded view of the elevator lantern system of FIG. 1.

Lens (120) is made of a translucent or semi-translucent material such that an LED or other light source, or illuminating features, may be shone through lens (120). Lens (120) of the exemplary version has a triangular shape, but it will be understood that lens (120) may have any suitable shape as would be apparent to one of ordinary skill in the art in view of the teachings herein. The illustrated version further shows lens (120) having a triangular shape pointed upwards, but it will be understood that lens (120) may also be pointed downwards, or in any other desired orientation as well. As seen in FIG. 4, lens (120) further comprises a plurality of clips (136) operable to affix lens (120) to tray (124) by pressing lens (120) against tray (124).

Figure 3:
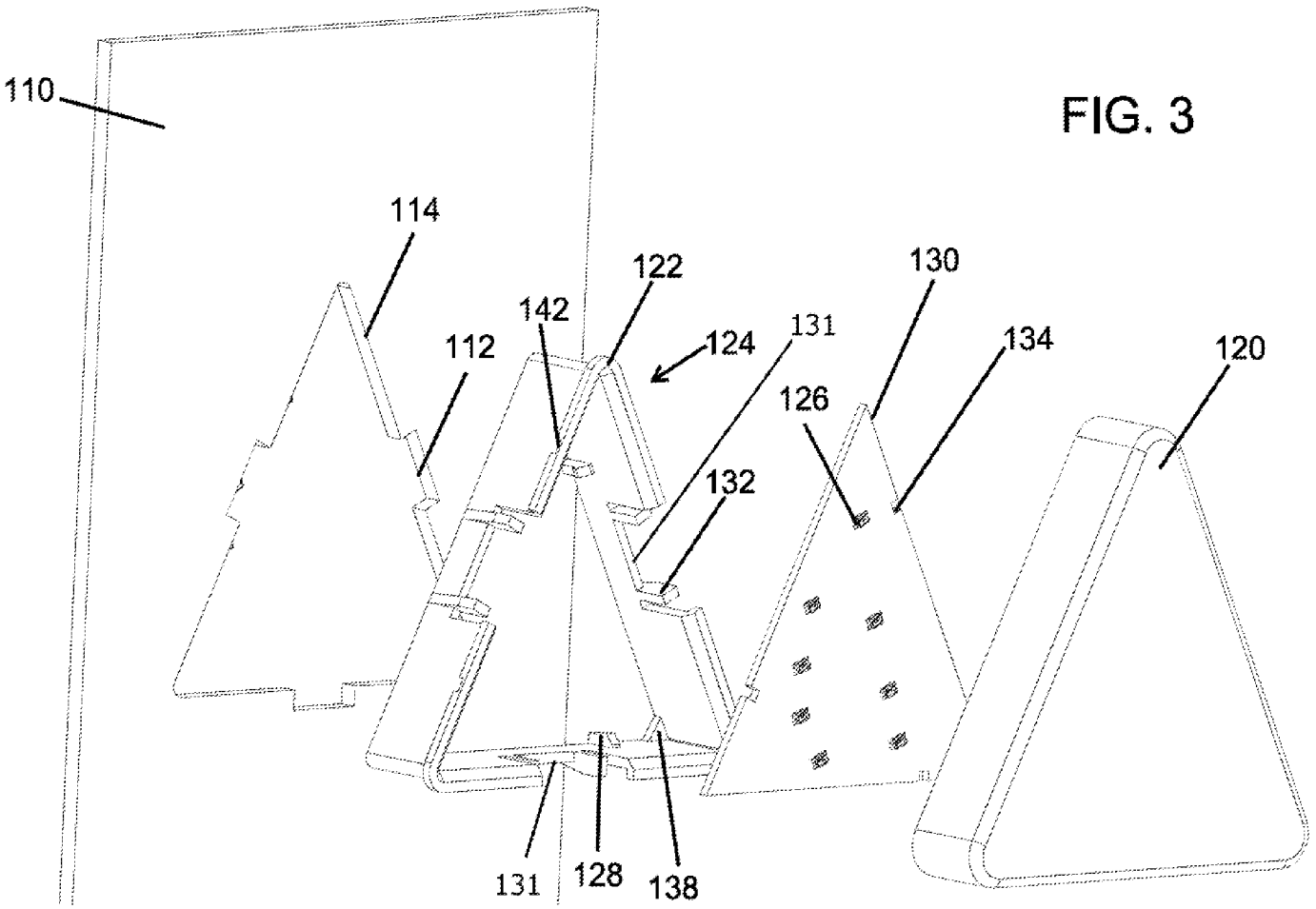
FIG. 3 depicts a perspective, exploded view of the elevator lantern system of FIG. 1.

Wall surface (110) of the exemplary version is constructed of a metal or other suitably rigid material. As seen in FIG. 3, wall surface (110) has opening (114) with a shape generally to complement the shape of tray (124). Opening (114) defines a set of notches (112) roughly sized to receive tabs (132) located on tray (124), which will be discussed in further detail below. Opening (114) in some versions may also be sufficiently large enough such that a user can access tray (124) and perform tasks to tray (124) as may be needed. It will be appreciated that wall surface (110) may be placed at an elevator landing or other suitable location without the use of a faceplate, wall plate, or other similar structure.

Figure 2:
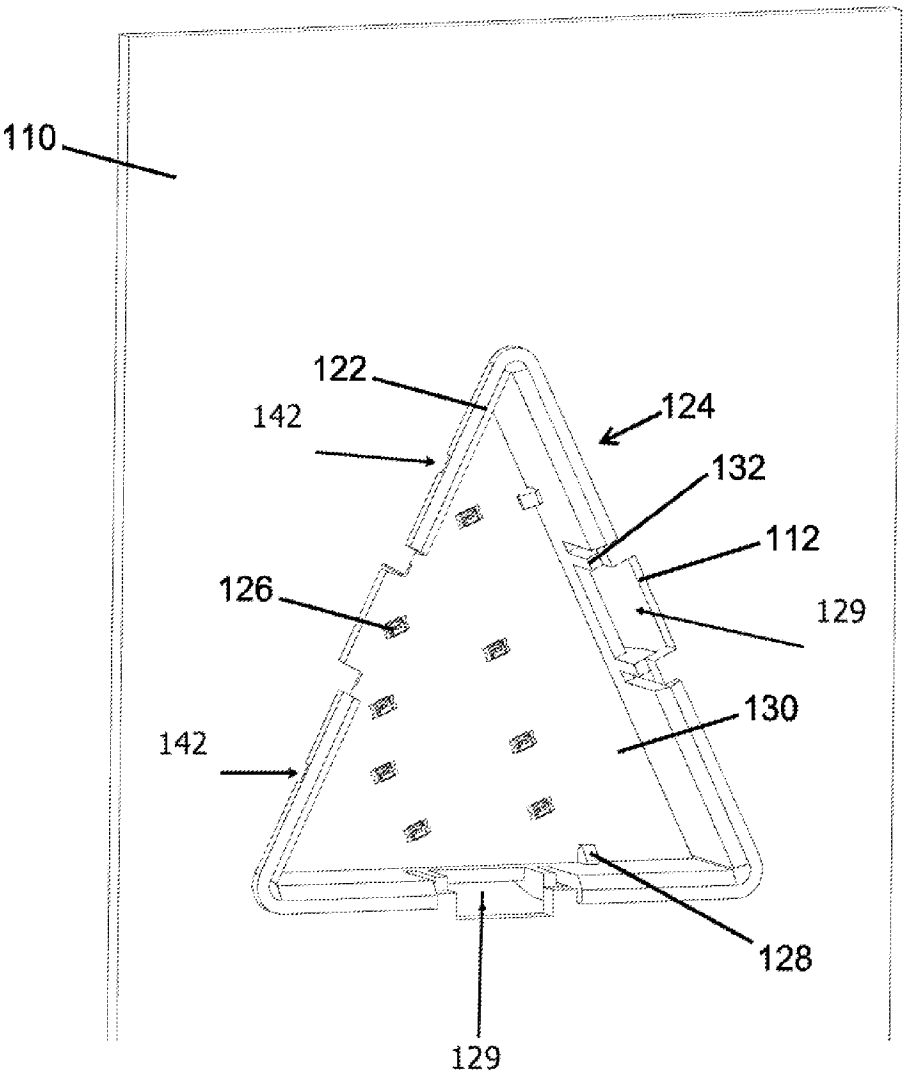
FIG. 2 depicts a perspective view of the elevator lantern system of FIG. 1 with the lens removed.

Referring now to FIG. 2, tray (124) includes board tabs (128), an outer lip (122), tray tabs (132), and lens notches (142). FIG. 3 shows tray (124) also includes corner stoppers (138). It will be understood that the various components of tray (124) may be constructed of a single unitary construction or may comprise separate components connected in any suitable manner using clips, screws, welding, etc. Tray (124) may be constructed of a rigid, plastic material, but may also be constructed of a metal or any other suitable material. In some versions, tray (124) is considered to comprise a first portion that generally extends rearward from wall surface (110), and a second portion that generally extends forward from wall surface (110). In some other versions for trays, first portion or second portion can be omitted. In some versions, tray (124) comprises first and second engaging features, e.g., in the illustrated version a first engaging feature includes outer lip (122) and a second engaging feature includes tray tabs (132). In other versions, other structures can be used as first and/or second engaging features as will be understood by those of ordinary skill in the art in view of the teachings herein.

Board tabs (128) along with corner stoppers (138) are operable to retain control board (130) once control board (130) is inserted into tray (124). Board tabs (128) are constructed to have a slight ramp such that control board (130) may be placed into tray (124) and pressed against board tabs (128). Once sufficient pressure is placed upon control board (130) against board tabs (128), the ramped shape of board tabs (128) enables control board (130) to slide past board tabs (128) and hit corner stoppers (138). At that point, board tabs (128) retain control board (130) between board tabs (128) and corner stoppers (138).

Outer lip (122) surrounds a substantial portion of tray (124) such that when tray (124) is placed within opening (114) such as shown in FIG. 2, outer lip (122) prevents tray (124) from falling through opening (114). Outer lip (122) of the exemplary version comprises a beveled ridge that extends around the outer portion of tray (124). However, it will be understood that outer lip (122) may comprise any suitable construction for preventing tray (124) from falling through opening (114).

Tray tabs (132) are arranged around tray (124). Tray tabs (132) comprise a slightly tapered construction such that tray (124) can be pushed through opening (114) without getting caught in opening (114). Once tray (124) is pushed through opening (114), tray tabs (132) snap against wall surface (110). Tray tabs (132) are further operable to retain tray (124) within wall surface (110) in conjunction with outer lip (122). In other words, wall surface (110) is between tray tabs (132) and outer lip (122) once tray (124) is inserted fully into wall surface (110). While in the exemplary version a pair of tray tabs (132) are used on each side of tray (124) it will be understood that any suitable number of tray tabs (132) may be used as would be apparent to one of ordinary skill in the art in view of the teachings herein.

Lens notches (142) are aligned with clips (136) such that when lens (120) is pressed against tray (124), clips (136) snap into lens notches (142). Lens notches (142) of the exemplary version may further be operable to produce an audible snap when lens (120) snaps into lens notches (142), though it will be understood that in some versions, an audible signal is not necessary. The haptic clicking of clips (136) with lens notches (142) may provide sufficient feedback.

Control board (130), as mentioned above, is placed within tray (124) as seen in FIG. 2. Control board (130) has a triangular shape operable to fit within tray (124). Control board (130) further comprises a plurality of LEDs (126) and a plurality of board notches (134) around the perimeter of control board (130). As seen in FIG. 4, the rear of control board (130) includes a control interface (140) operable to interface with an elevator control system such that signals to light up elevator lantern system (100) can be received. Furthermore, control interface (140) may be used to deliver power to illuminate LEDs (126).

While control board (130) has a triangular shape, it will be appreciated that control board (130) may have any suitable shape operable to complement tray (124). Furthermore control board (130) may include any printed circuit board (PCB) operable to provide communication between LEDs (126) and control interface (140).

LEDs (126) are in communication with control interface (140) such that LEDs can receive signals from an elevator control of when to illuminate. In the illustrated version, LEDs (126) are used, but it will be appreciated that other lighting sources may be used as well. For instance, incandescent, fluorescent, compact fluorescent, or any other suitable bulb may be used in place of LEDs (126) as would be apparent to one of ordinary skill in the art in view of the teachings herein.

Notches (134) are positioned around control board (130) such that notches (134) line up with board tabs (128). Furthermore, notches (134) are sized to approximately match the size of board tabs (128). As a result, as control board (130) is pressed against board tabs (128), notches (134) enable control board (130) to more easily snap into position between board tabs (128) and corner stoppers (138).

Thus, in an exemplary assembly of elevator lantern system (100), control board (130) may be snapped into tray (124) between board tabs (128) and corner stoppers (138). Tray (124) may then be pressed into opening (114) to snap tray (124) into opening (114) such that wall surface (110) is between tray tabs (132) and lip (122). Lens (120) may then be pressed against tray such that clips (136) snap into lens notches (142). Control interface (140) may be connected to a cable or other device to provide communication between elevator lantern system (100) and an elevator control system. Connection of control interface (140) can occur prior to placing tray (124) with control board (130) into opening (114).

In the event that a user needs to access the components within elevator lantern system (100), the user may simply remove lens (120) by pulling on lens (120) to unclip clips (136) from lens notches (142). Alternatively, the user may also use an access tool to remove lens (120), which will be described in further detail below. In some versions an access tool may not be necessary and lens (120) is sufficiently resilient such that a user can gently squeeze the sides of lens (120) near clips (136) to cause the sides of lens (120) and clips (136) to flex inward and thereby disengage from lens notches (142) so that lens (120) can be removed from tray (124). Furthermore, tray (124) can be removed from opening (114) by either using an access tool to disengage tray tabs (132) from notches (112) of opening (114), or by gently squeezing the sides of tray (124) between tray tabs (132) to cause tray tabs (132) to resiliently flex inward to disengage from notches (112). As seen in FIG. 2, with tray (124) inserted within wall surface (110) there is a space (129) defined by the cutouts (131) in tray (124) and notches (112) in opening (114) of wall surface (110). This space (129) provides a person with a location to grip tray (124) and gently squeeze tray (124) to disengage tray (124) from opening (114). As shown and described, lantern system (100) is able to be assembled and removed or accessed without the use of tools or fasteners, and lantern system (100) can be serviced (and assembled or disassembled) from the front side of lantern system (100) that would otherwise face passengers or users of the elevator. Accordingly, control board (130) is accessible when lens (120) is removed from elevator lantern (100).

II. Exemplary Arrow Shaped Elevator Lantern

Figure 5:
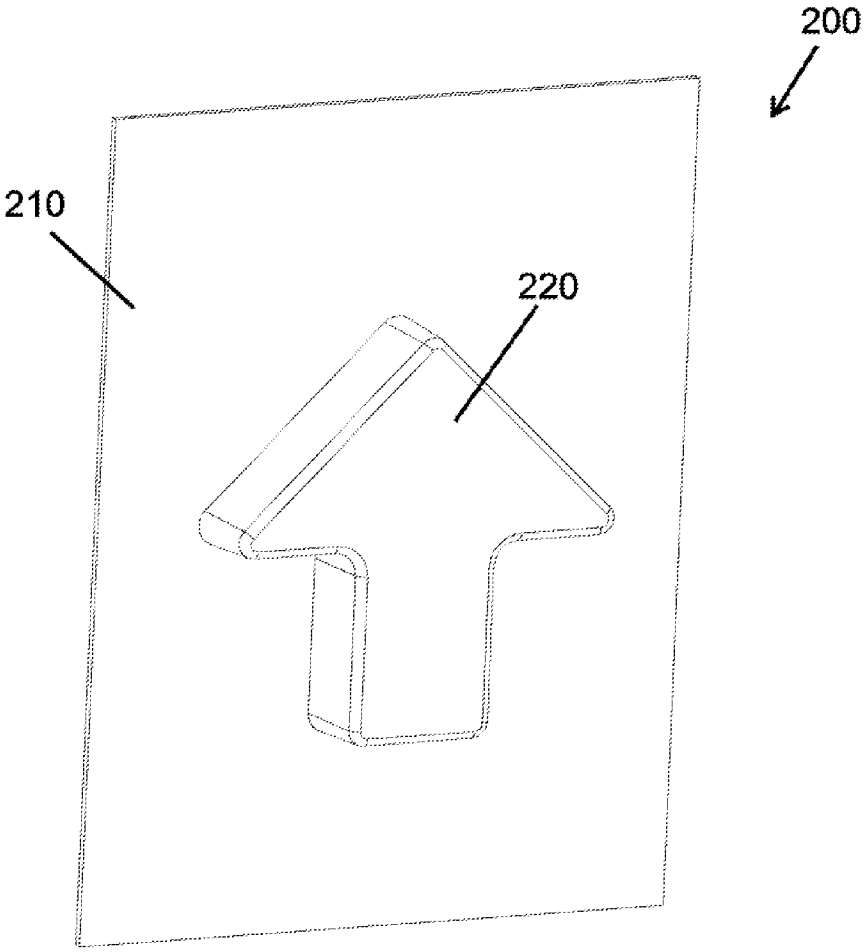
FIG. 5 depicts a perspective view of an alternative exemplary elevator lantern system shaped like an arrow.
Figure 6:
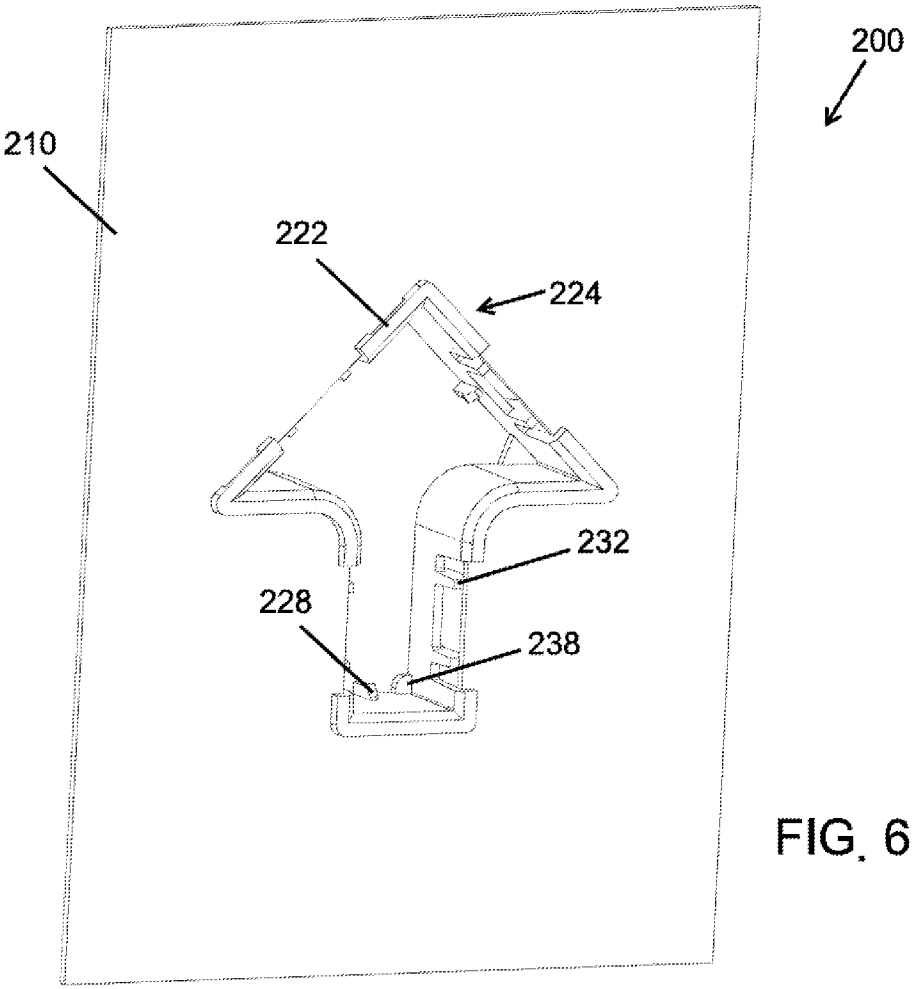
FIG. 6 depicts a perspective view of the elevator lantern system of FIG. 5 with the lens removed.

In some instances it may be desirable to have an elevator lantern system (100) shaped like an arrow rather than shaped like a triangle. FIG. 5 shows an exemplary elevator lantern system (200) shaped like an arrow having a wall surface (210) and lens (220). FIG. 6 shows lens (220) removed and shows that elevator lantern system (200) further comprises a tray (224). It will be appreciated that the various components of elevator lantern system (200) including wall surface (210), lens (220), and tray (224) function in a substantially similar way to wall surface (110), lens (120), and tray (124) of elevator lantern system (100) shown in FIGS. 1-4.

Figure 7:
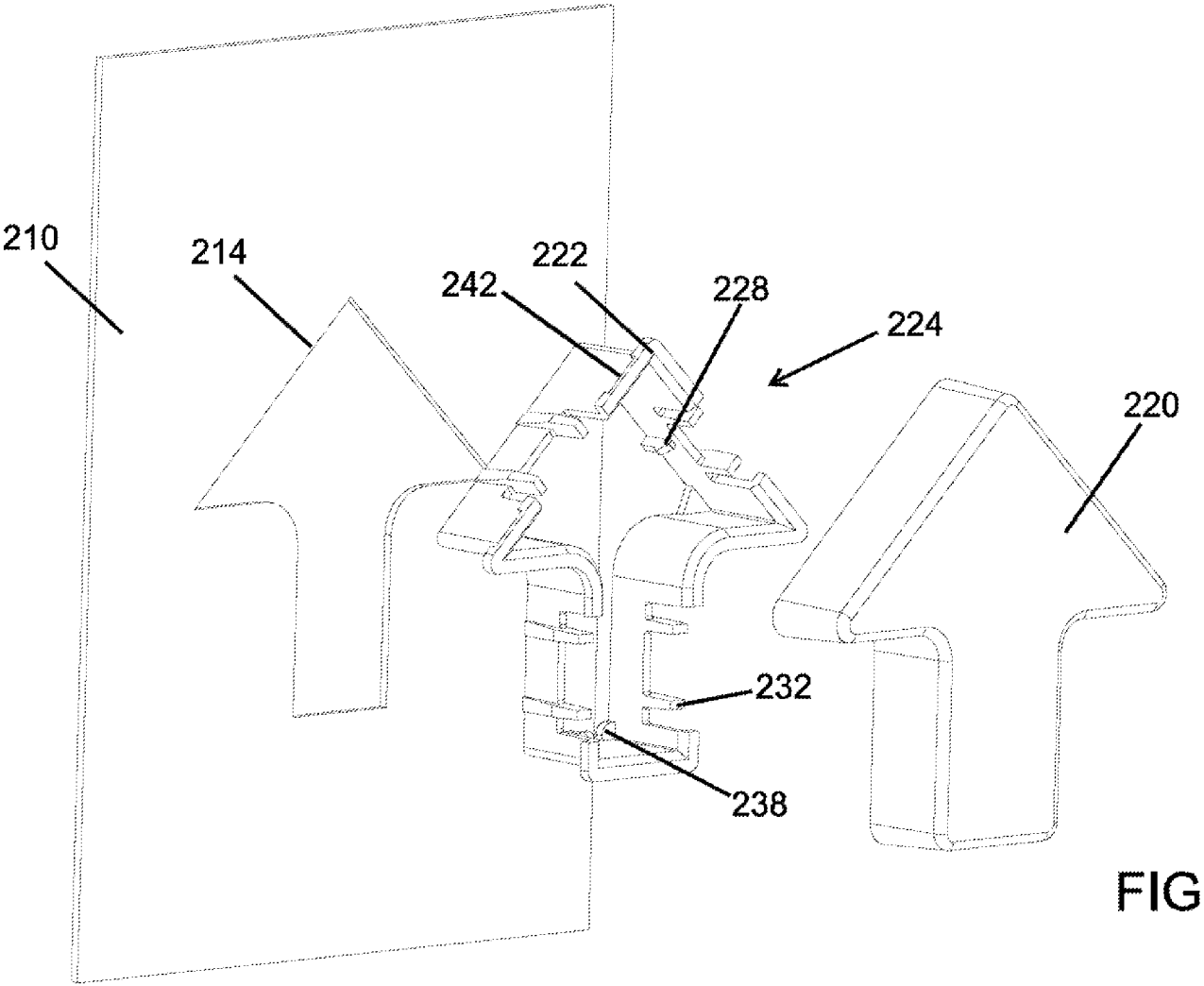
FIG. 7 depicts a perspective, exploded view of the elevator lantern system of FIG. 5.

Wall surface (210) of the exemplary version has an arrow shaped opening (214) as can be seen in FIG. 7. Tray (224) is operable to fit within opening (214), and lens (220) is operable to snap onto tray (224).

FIG. 7 shows that tray (224) comprises an outer lip (222), board tabs (228), corner stoppers (238), tray tabs (232), and lens notches (242). Outer lip (222) comprises a lip that extends around portions of the perimeter of tray (224). As shown in the illustrated version, outer lip (222) has a shape to complement the arrow shape of lens (220).

Board tabs (228) have an angled surface such that an arrow-shaped control board (not shown in FIG. 7) may be placed into tray (224) and pressed to slide past board tabs (228). Board tabs (228) are spaced around the perimeter of tray (224), and in some versions, such that at least one board tab (228) is positioned on each side of the arrow defined by the footprint of tray (224). It will be understood that more or less board tabs (228) may be used as would be apparent to one of ordinary skill in the art in view of the teachings herein.

Corner stoppers (238) are positioned at corners of the arrow defined by the footprint of tray (224). Once an arrow-shaped control board is pressed through board tabs (228), corner stoppers (238) prevent the control board from falling completely through tray (224). The control board is held between board tabs (228) and corner stoppers (238). In the illustrated version shown in FIG. 8, corner stoppers (238) have a rounded or flat shape, but it will be appreciated that any suitable shape for corner stoppers (238) may be used as would be apparent to one of ordinary skill in the art in view of the teachings herein. Also, the arrow-shaped control board may include board notches similar to board notches (134) of lantern system (100) for engaging with board tabs (228).

Tray tabs (232) along with outer lip (222) are operable to selectively secure tray (224) to wall surface (210) once tray (224) is fully inserted into wall surface (210). Tray tabs (232) are also ramped such that when inserted into wall surface (210), tray (224) forms a friction fit with wall surface (210). Upon pressing tray (224) further into opening (214), tray (224) snaps into place such that tray tabs (232) and outer lip (222) retain tray (224) within wall surface (210) from opposing sides as may be seen in FIG. 6. It will be understood that tray tabs (232) are rigid, yet flexible and resilient enough such that tray (224) can still be removed after being installing into wall surface (210).

Figure 8:
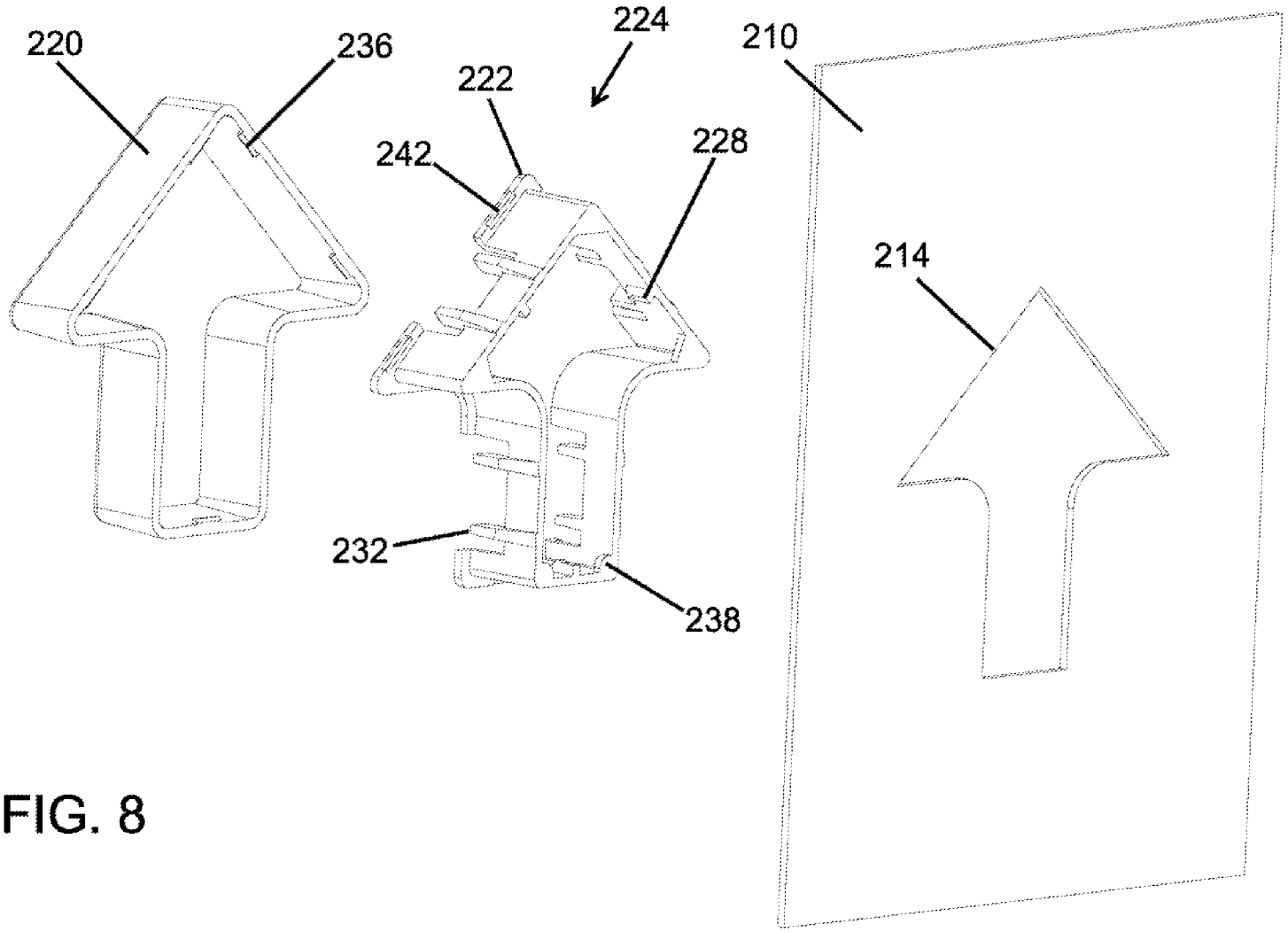
FIG. 8 depicts a rear, perspective, exploded view of the elevator lantern system of FIG. 5.
Figure 9:
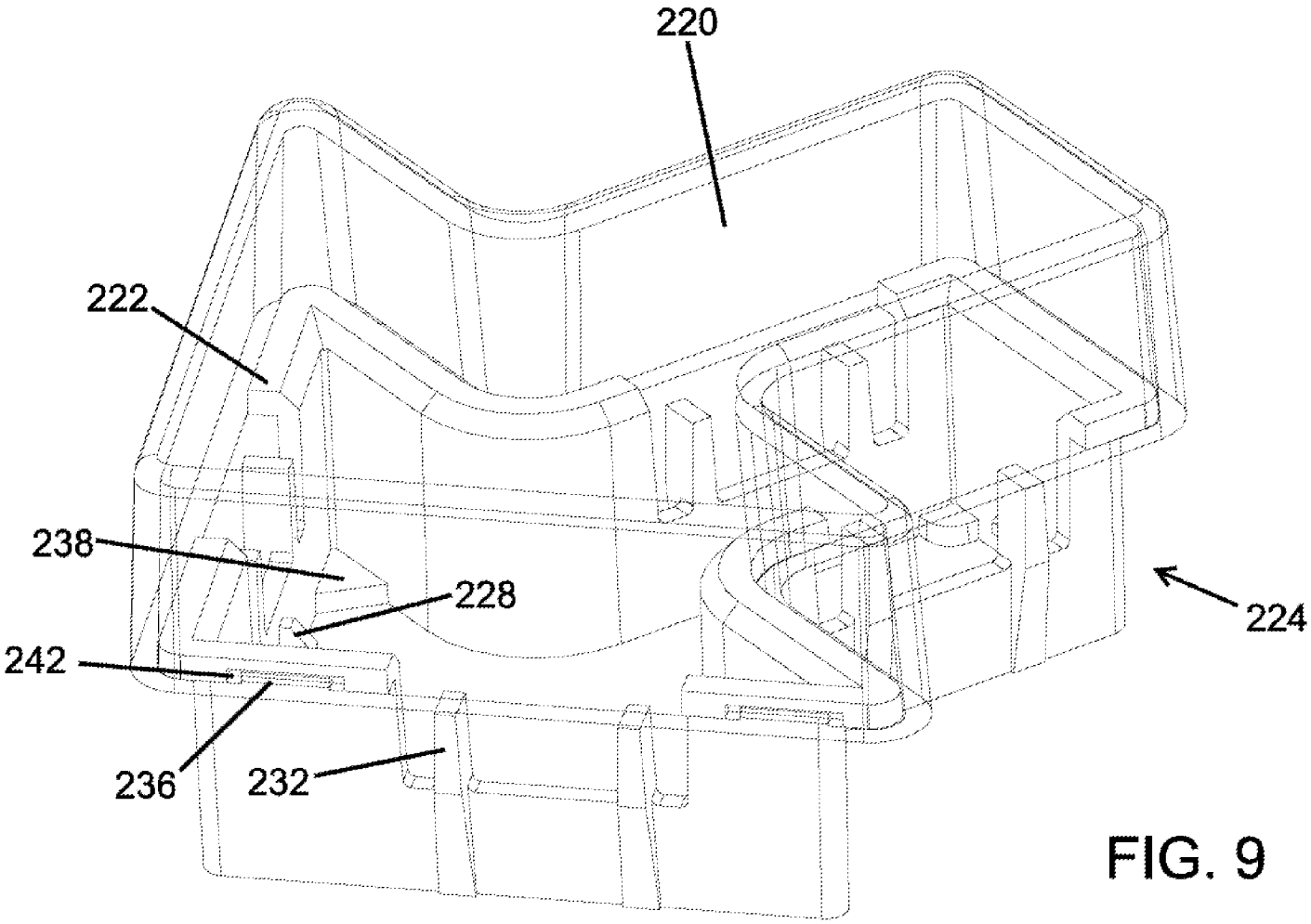
FIG. 9 depicts a perspective, partially transparent view of the elevator lantern system of FIG. 5 with the wall surface not shown.

Lens notches (242) are operable to receive clips (236) from lens (220). As seen in FIG. 8, lens notches (242) are arranged around outer lip (222) such that lens notches are aligned with clips (236). As a result, when lens (220) is pressed against outer lip (222) of tray (224) with sufficient force, lens (220) snaps onto clips (236). Once snapped onto clips (236), lens (220) may later be removed by a user pulling lens (220) away from tray (224). FIG. 9 shows lens (220) attached to tray (224) with wall surface (210) not shown such that the interface between clips (236) and lens notches (242) can be more clearly seen. As can be seen in FIG. 9, lens notches (242) have substantially the same width as clips (236), through it will be appreciated that in some versions, lens notches (242) and clips (236) may have different sizes. As also seen in FIG. 9, once lens (220) engages tray (224) through lens notches (242) and clips (236), lens (220) fits completely over outer lip (222) and opening (214). Thus a clean appearance for a lantern system is provided without the need for a faceplate, wall plate, or other similar structure.

Assembly and removal of components of lantern system (200) could take place as described above with respect to lantern system (100).

III. Exemplary Elevator Lantern with Front Pressure Insertion

Figure 10:
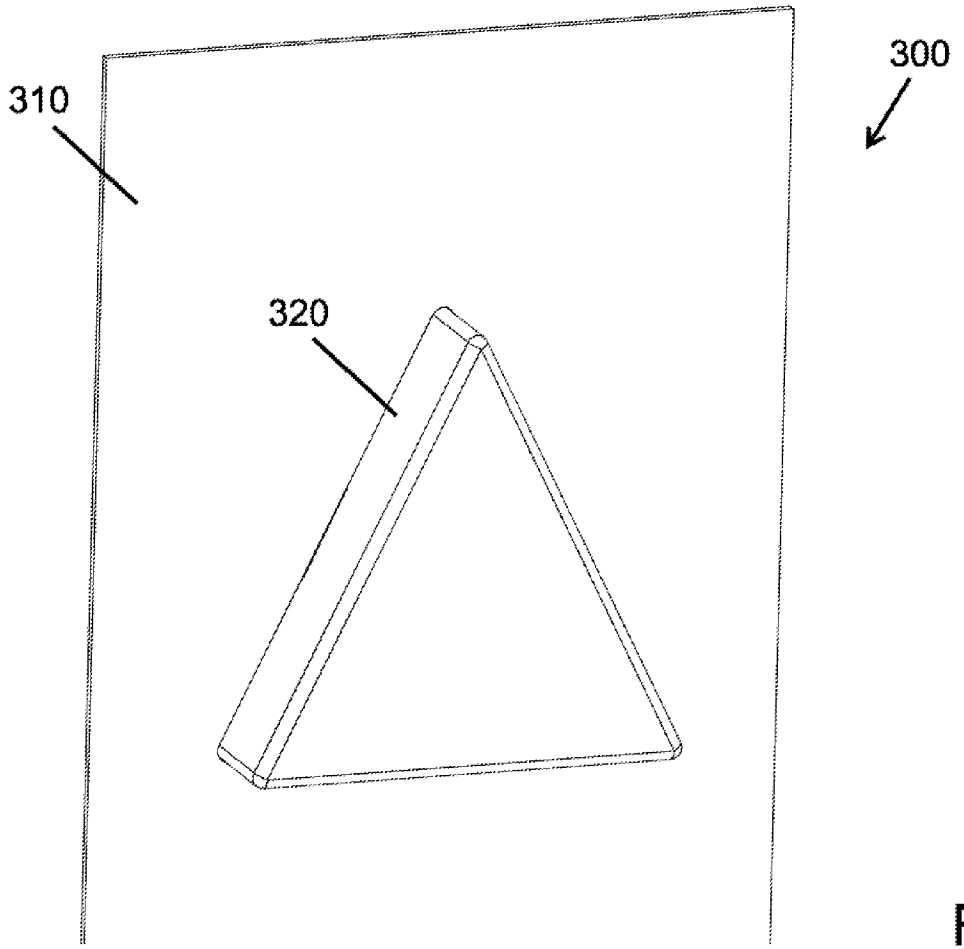
FIG. 10 depicts a perspective view of an alternative exemplary elevator lantern system with pressure tabs.
Figure 13:
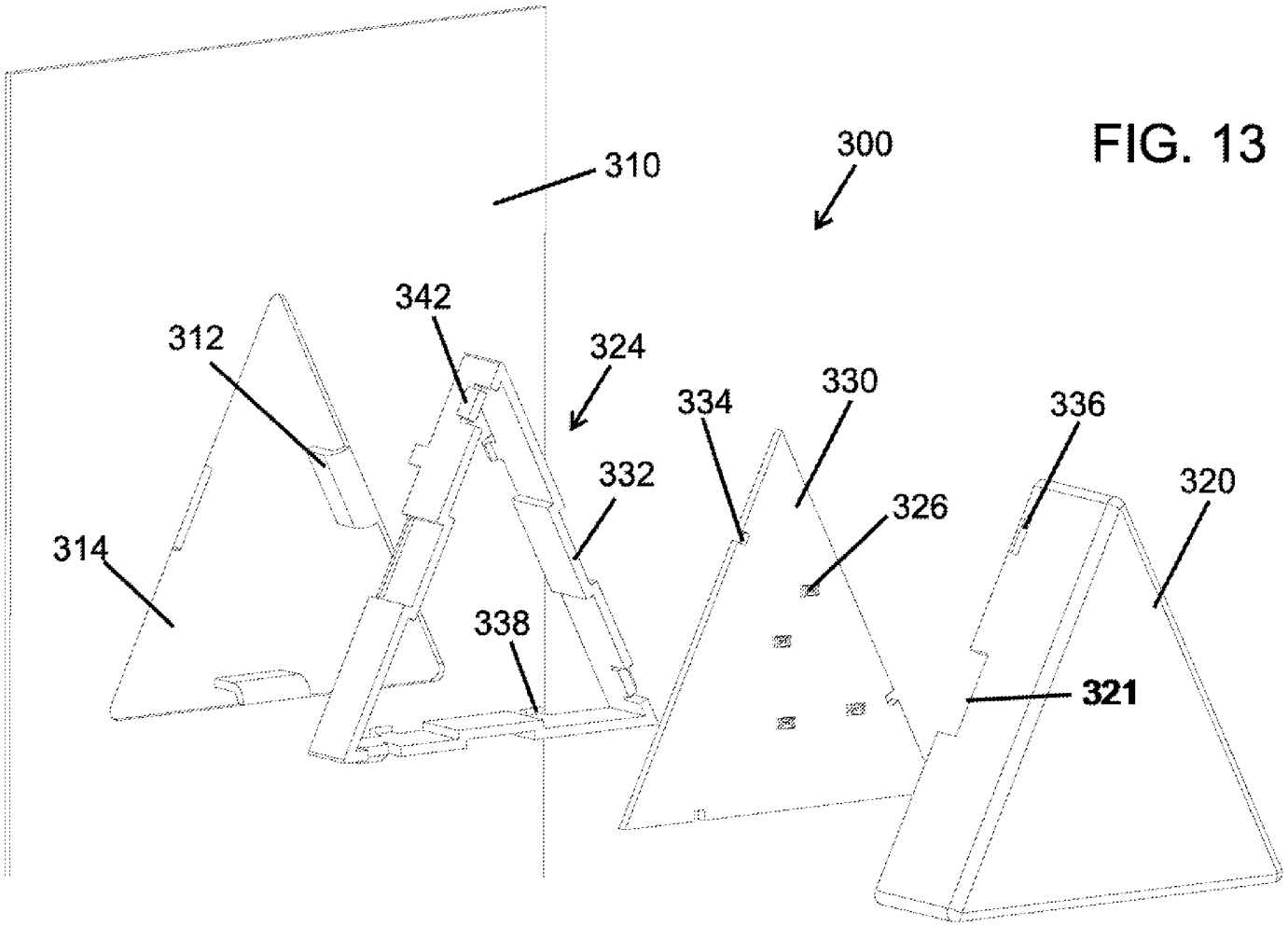
FIG. 13 depicts a perspective, exploded view of the elevator lantern system of FIG. 10.

FIG. 10 shows yet another exemplary elevator lantern system (300) comprising a wall surface (310) and lens (320). FIG. 13 shows that elevator lantern system (300) comprises a control board (330) as well.

Figure 11:
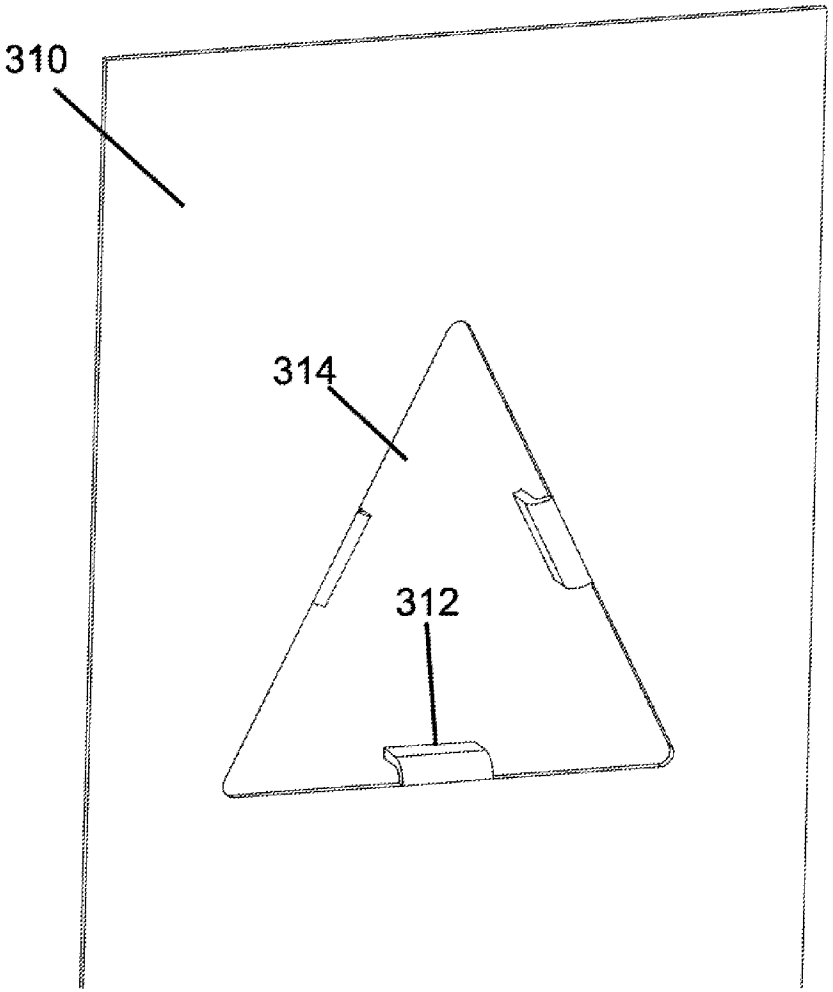
FIG. 11 depicts a perspective view of the wall surface of the elevator lantern system of FIG. 10.
Figure 12:
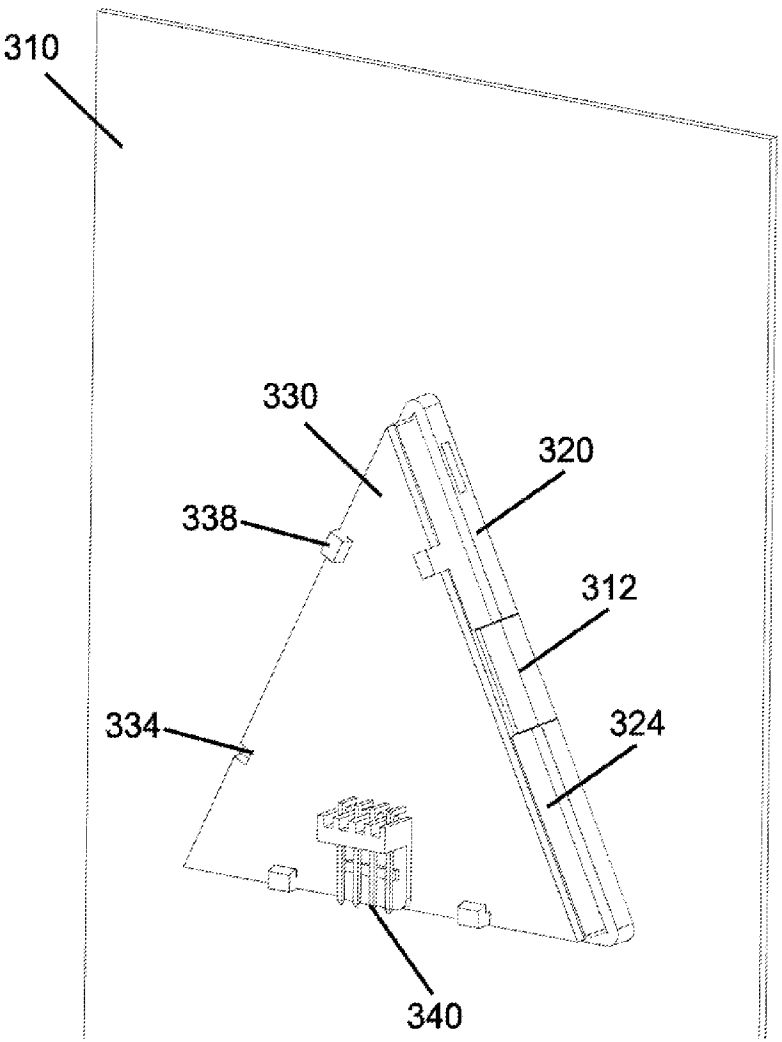
FIG. 12 depicts a rear, perspective view of the elevator lantern system of FIG. 10.

FIG. 11 shows wall surface (310) defining an opening (314). Wall surface (310) also comprises pressure tabs (312). Opening (314) is shaped to be a triangle, having slightly rounded points, but it will be understood that any suitable shape for opening (314) may be used as would be apparent to one of ordinary skill in the art in view of the teachings herein.

Pressure tabs (312) comprise portions of metal bent as seen in FIG. 11. Pressure tabs (312) are pre-bent and shaped to receive tray (324) into wall surface (310). Pressure tabs (312) may further be resiliently biased such that pressure tabs (312) apply pressure to tray (324) to help retain tray (324) within wall surface (310). Pressure tabs (312) are angled to extend generally perpendicularly from wall surface (310), but any suitable angle may be used. While the exemplary version shows pressure tabs (312) having a rectangular bent shape, it will be appreciated that any suitable shape for pressure tabs (312) may be used as would be apparent to one of ordinary skill in the art in view of the teachings herein. Furthermore, the exemplary version has a pressure tab (312) located along each side of opening (314), but it will be understood that any suitable number of pressure tabs (312) may be used as would be apparent to one of ordinary skill in the art in view of the teachings herein.

Lens (320) of the exemplary version has a triangular shape and comprises a translucent or semi-translucent material such that a light shining inside of lens (320) will illuminate lens (320). Lens (320) defines lens notches (336) operable to engage lens (320) with tray (324). In the exemplary version, lens notches (336) comprise a slit on each side of lens (320), but it will be appreciated that any suitable shape for lens notches (336) may be used as would be apparent to one of ordinary skill in the art in view of the teachings herein. Furthermore, more or fewer lens notches (336) may be used as would be apparent to one of ordinary skill in the art in view of the teachings herein. For instance, two, three, four, or more lens notches (336) may be used. In other versions, some sides of lens (320) may have lens notches (336) whereas other sides exclude lens notches (336). Lens (320) further defines rectangular tab cutouts (321) operable to fit pressure tabs (312) when tray (324) and lens (320) are positioned within wall surface (310).

Figure 14:
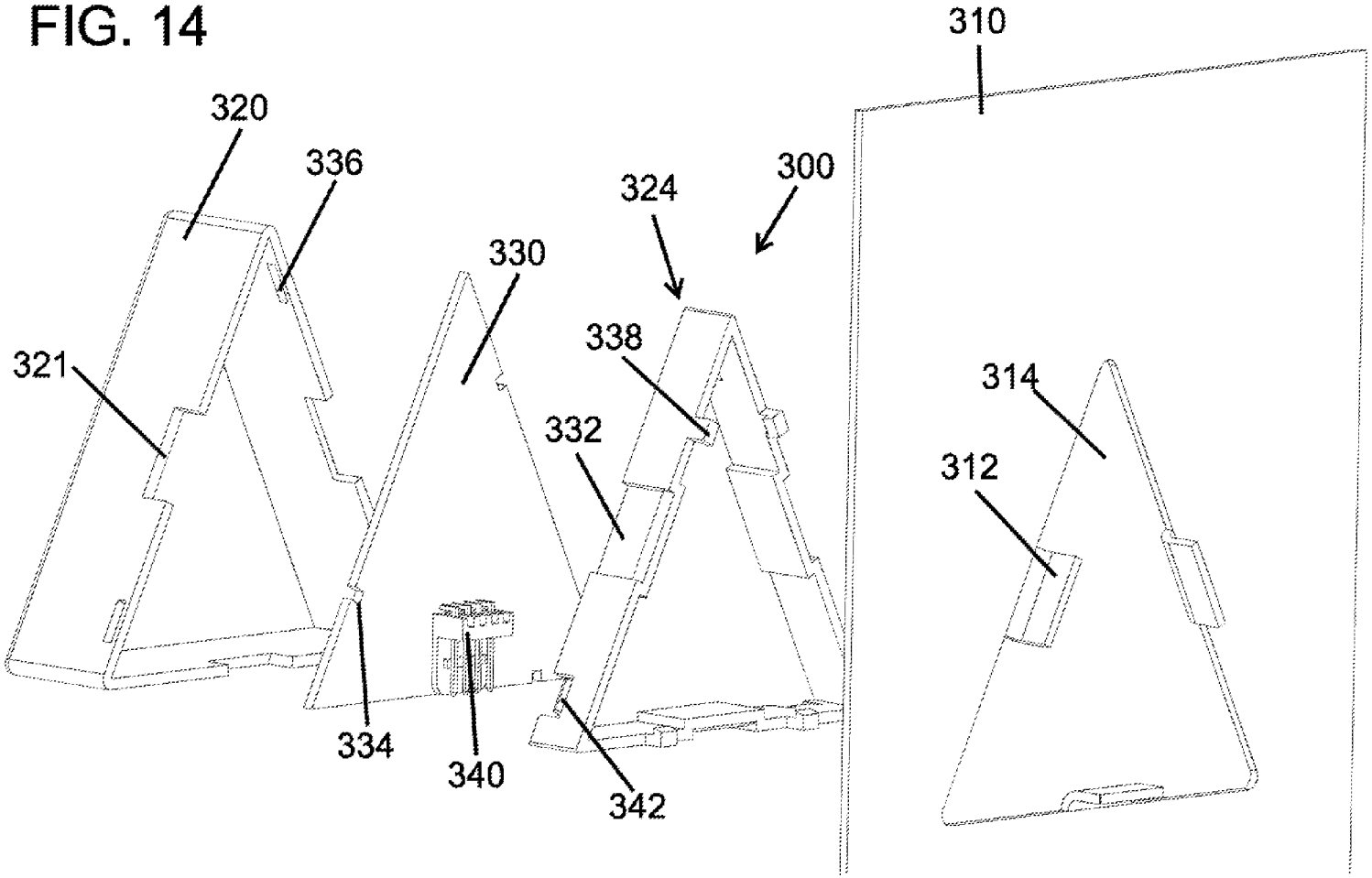
FIG. 14 depicts a rear, perspective, exploded view of the elevator lantern system of FIG. 10.

Control board (330) of the exemplary version comprises LEDs (326), which can be seen in FIG. 13. Control board (330) also comprises a control interface (340) which can be seen in FIG. 14 on the back of control board (330). Along the sides of control board (330) are board notches (334) operable to engage control board (330) with tray (324).

Control board (330) has a triangular shape operable to fit within tray (324), but it will be appreciated that other suitable shapes for control board may be used as would be apparent to one of ordinary skill in the art. For instance, in the event that tray (324) has a rectangular, square, circular, or elliptical shape, control board (330) may also have a similar shape.

LEDs (326) seen in FIG. 13 are operable to illuminate such that lens (320) projects the illumination from LEDs (326). The exemplary version shows elevator lantern system (300) having four LEDs (326), but it will be appreciated that any suitable number of LEDs (326) may be used. Furthermore, LEDs (326) may be arranged in any suitable arrangement as would be apparent to one of ordinary skill in the art in view of the teachings herein. Additionally, other suitable lights may be used instead of LEDs (326). For instance, fluorescent bulbs, compact fluorescent bulbs, incandescent bulbs, laser, or any other suitable light operable to illuminate lens (320).

Control interface (340) is operable to communicate with an elevator control system to receive instruction from the elevator control system. Control interface (340) is also in communication with LEDs (326) through control board (330). For instance, control interface (340) may be in communication through control board (330) through wires or contacts extending through control board (330). As a result, control interface (340) is operable to send instructions to LEDs (326) to illuminate LEDs (326). While control interface (340) is positioned at the rear of control board (330), it will be appreciated that control interface (340) may be placed at any suitable location.

Tray (324) has a generally triangular shape operable to fit within opening (314) of wall surface (310). Tray (324) comprises board tabs (338), tab recesses (332), and lens tabs (342). Board tabs (338) are operable to retain control board (330) once control board (330) is placed through tray (324). Board tabs (338) are shaped to complement board notches (334) such that control board (330) may be pressed through board tabs (338) to couple with board notches (334).

Tab recesses (332) are defined by the walls of tray (324). Tab recesses (332) are further operable to couple with pressure tabs (312) to retain tray (324) within wall surface (310). In particular, as tray (324) is slid into opening (314) of wall surface (310), pressure tabs (312) slide into tab recesses (332). In the present example, the orientation of pressure tabs (312), their resilient bias, and the manner in which they contact tab recesses (332) cause pressure tabs (312) to exert a force on the tab recesses (312) that is sufficient to retain tray (324) in position within opening (314) of wall surface (310). Furthermore, in some versions, tab recesses (332) are shaped such that once pressure tabs (312) are fully inserted into tab recesses (332), tab recesses (332) provide a haptic or audio sound indicating that pressure tabs (312) are inserted into tab recesses (332).

Figure 15:
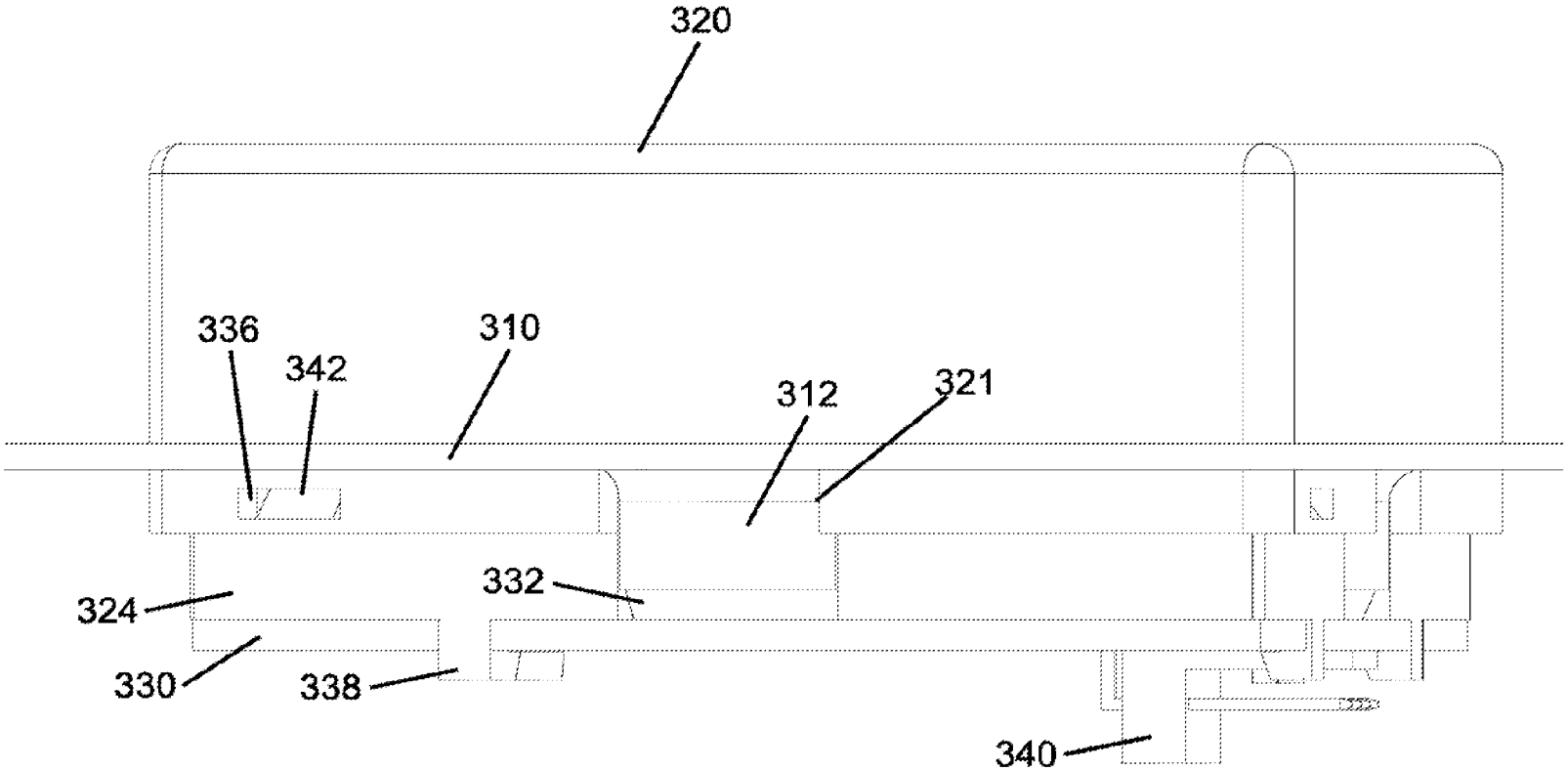
FIG. 15 depicts a side, elevation view of the elevator lantern system of FIG. 10.
Figure 16:
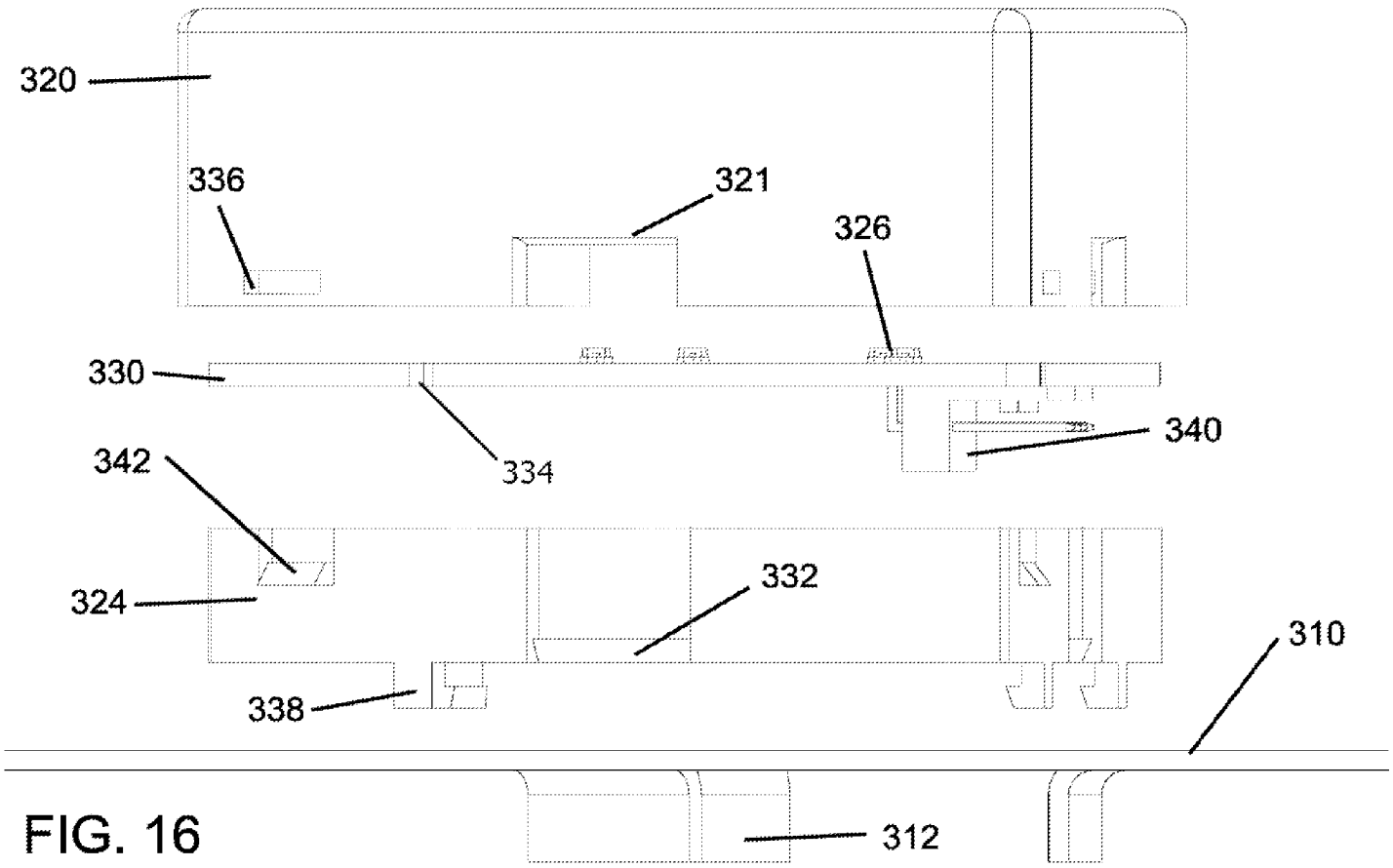
FIG. 16 depicts a side, exploded, elevation view of the elevator lantern system of FIG. 10.

Lens tabs (342) are shaped to couple with lens notches (336). After tray (324) and control board (330) are placed within wall surface (310), lens (320) may be pressed into tray (324) such that lens notches (336) and lens tabs (342) snap together. When the user desires to access control board (330) or any other component under lens (320), the user can pull on lens (320) such that lens notches (336) and lens tabs (342) decouple and release lens (320). The exemplary version shows three lens tabs (342) being used, but any suitable number of lens tabs (342) may be used as would be apparent to one of ordinary skill in the art. FIG. 15 shows lens tabs (342) coupled with lens notches (336) as well as pressure tabs (312) coupled with tab recesses (332). Furthermore, board tabs (338) coupled with board notches (334) can also be seen. FIG. 16 shows lens tabs (342) released from lens notches (336), pressure tabs (312) released from tab recesses (332), and board tabs (338) released from board notches (334).

IV. Exemplary Elevator Lantern with Foam Layer

It will be appreciated that in some instances, it may be desirable to use an elevator lantern system without necessarily using a custom opening in the wall surface where the opening has protrusions or other features operable to accommodate a tray or lens.

Figure 17:
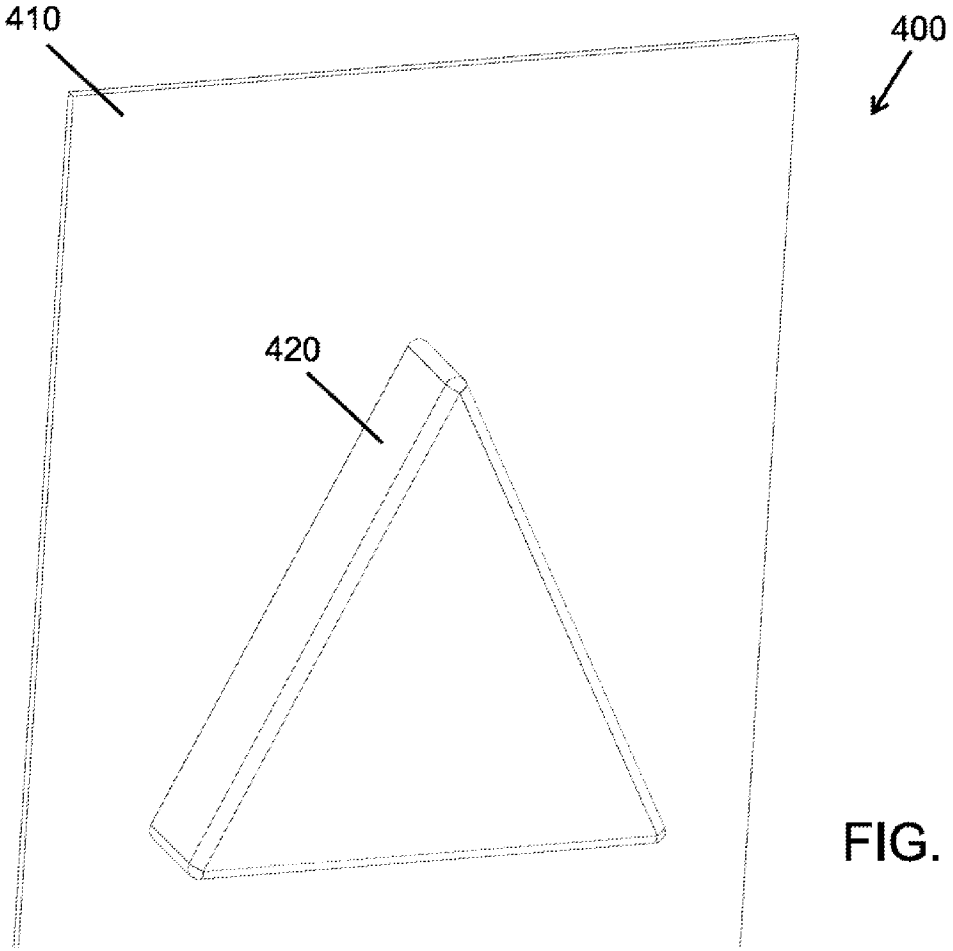
FIG. 17 depicts a perspective view of an alternative exemplary elevator lantern system with a foam layer.
Figure 19:
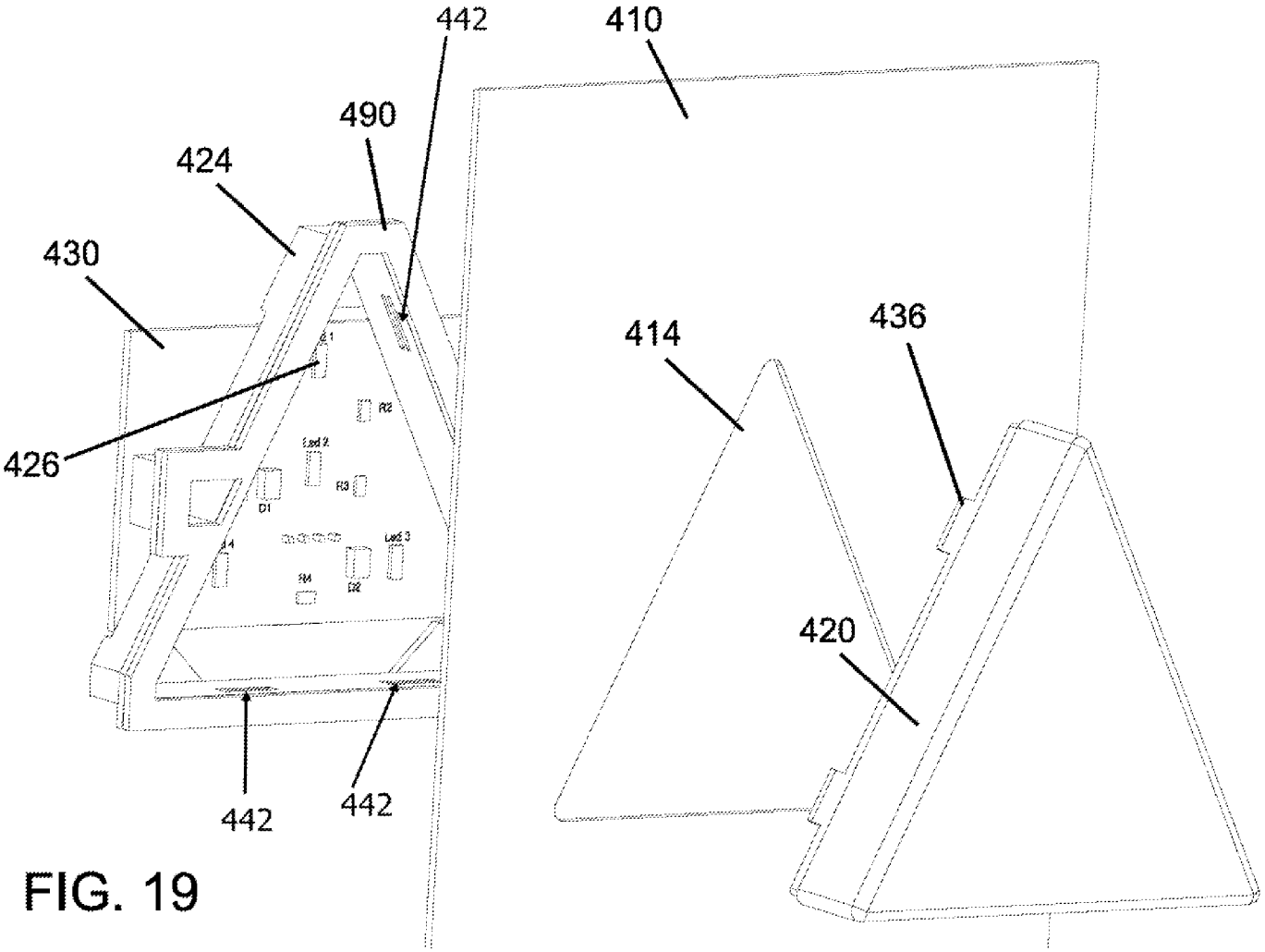
FIG. 19 depicts a perspective, exploded view of the elevator lantern system of FIG. 17.

FIG. 17 shows an exemplary elevator lantern system (400) having a lens (420) and wall surface (410). It will be understood that wall surface (410) of the exemplary version has a triangular opening (414) as seen in FIG. 19, but it will be understood that any suitable shape may be used.

Lens (420) comprises a triangular shape, but it will be appreciated that any suitable shape for lens (420) may be used. Lens (420) comprises lens clips (436). In the exemplary version, lens clips (436) extend outward from lens (420). It will be appreciated that lens clips (436) are generally rigid, but also flexible and resilient enough such that lens clips (436) can fit through opening (414) to couple lens (420) with tray (424), which will be described in further detail below. Lens (420) is constructed of a translucent or semi-translucent material such that a light within lens (420) can be seen shining through lens (420).

Elevator lantern system (400) further comprises a tray (424) (seen in FIG. 18), a foam layer (490) (seen in FIG. 19), and a control board (430). In the present example, foam layer (490) comprises an adhesive material on the side facing wall surface (410), such that tray (424) is held against wall surface (410) by this foam layer (490) with adhesive. Also in the present example, foam layer (490) comprises an adhesive on the side that contacts tray (424) such that foam layer (490) is secured to tray (424) in this way. Control board (430) snaps onto tray (424) as described further below. It will be appreciated that in some instances, wall surface (410) may include a pre-existing opening such that elevator lantern system (400) may be used to retrofit the pre-existing lantern system.

Tray (424) includes lens notches (442) operable to receive lens clips (436). Lens notches (442) in the exemplary version comprise a double layered slit such that lens clips (436) may couple with either of lens notches (442). Having more than one lens notch (442) for lens clips (436) to couple with enables elevator lantern system (400) to work with wall surfaces (410) having various thicknesses. While two lens notches (442) are shown for lens clips (436) to engage, it will be understood that any suitable number of lens notches (442) may be used as would be apparent to one of ordinary skill in the art in view of the teachings herein. It will further be understood that lens notches (442) are arranged about tray (424) such that they align with lens clips (436).

Tray (424) further comprises board tabs (438) operable to couple with control board (430). Board tabs (438) have a split mushroom top shape such that bores (not shown) in control board (430) can be pressed against board tabs (438) to snap control board (430) to tray (424). In the exemplary version, a pair of board tabs (438) is used, but any suitable number of board tabs (438) may be used as would be apparent to one of ordinary skill in the art in view of the teachings herein.

Figure 20:
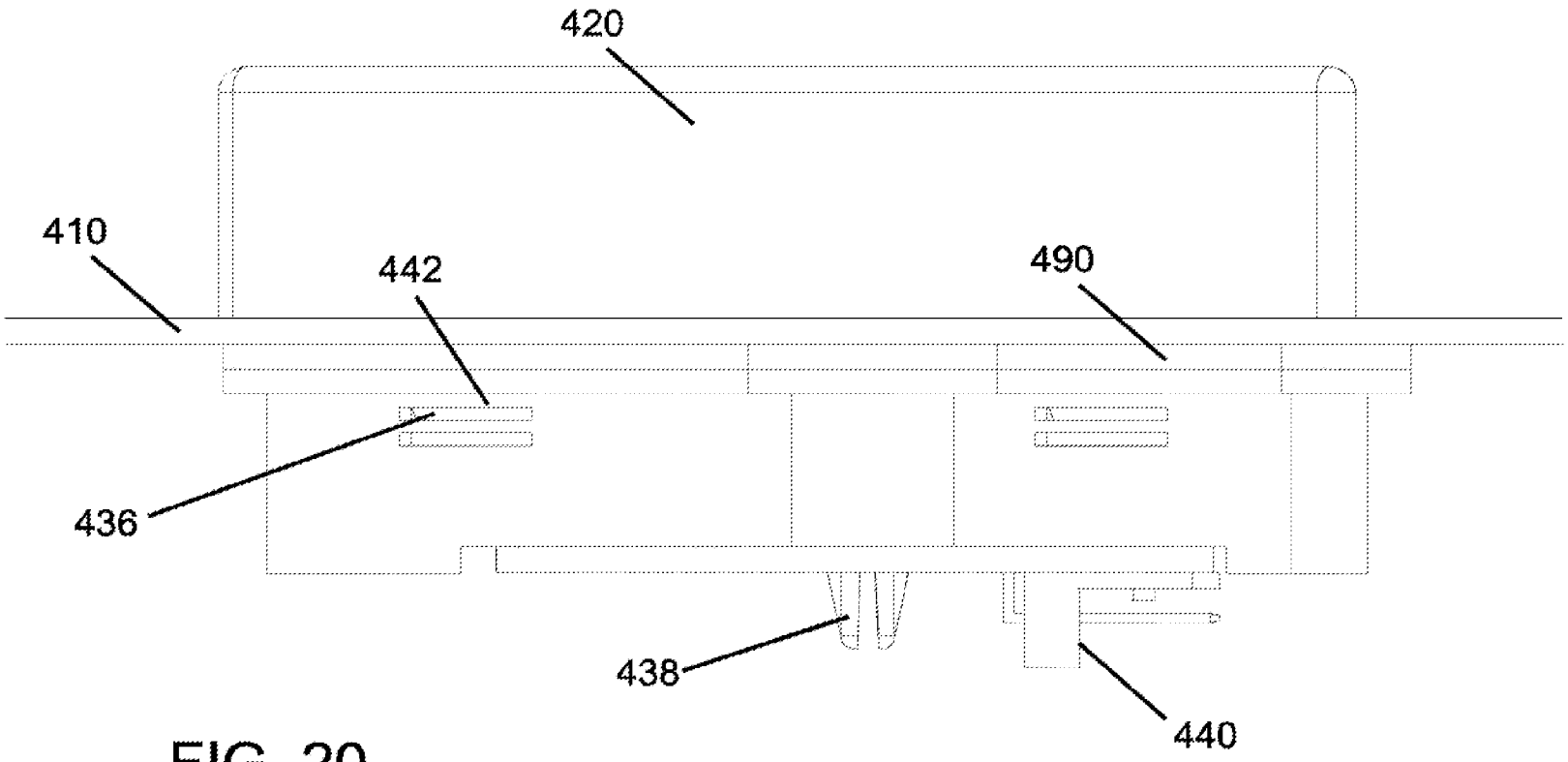
FIG. 20 depicts a side, elevation view of the elevator lantern system of FIG. 17.
Figure 21:
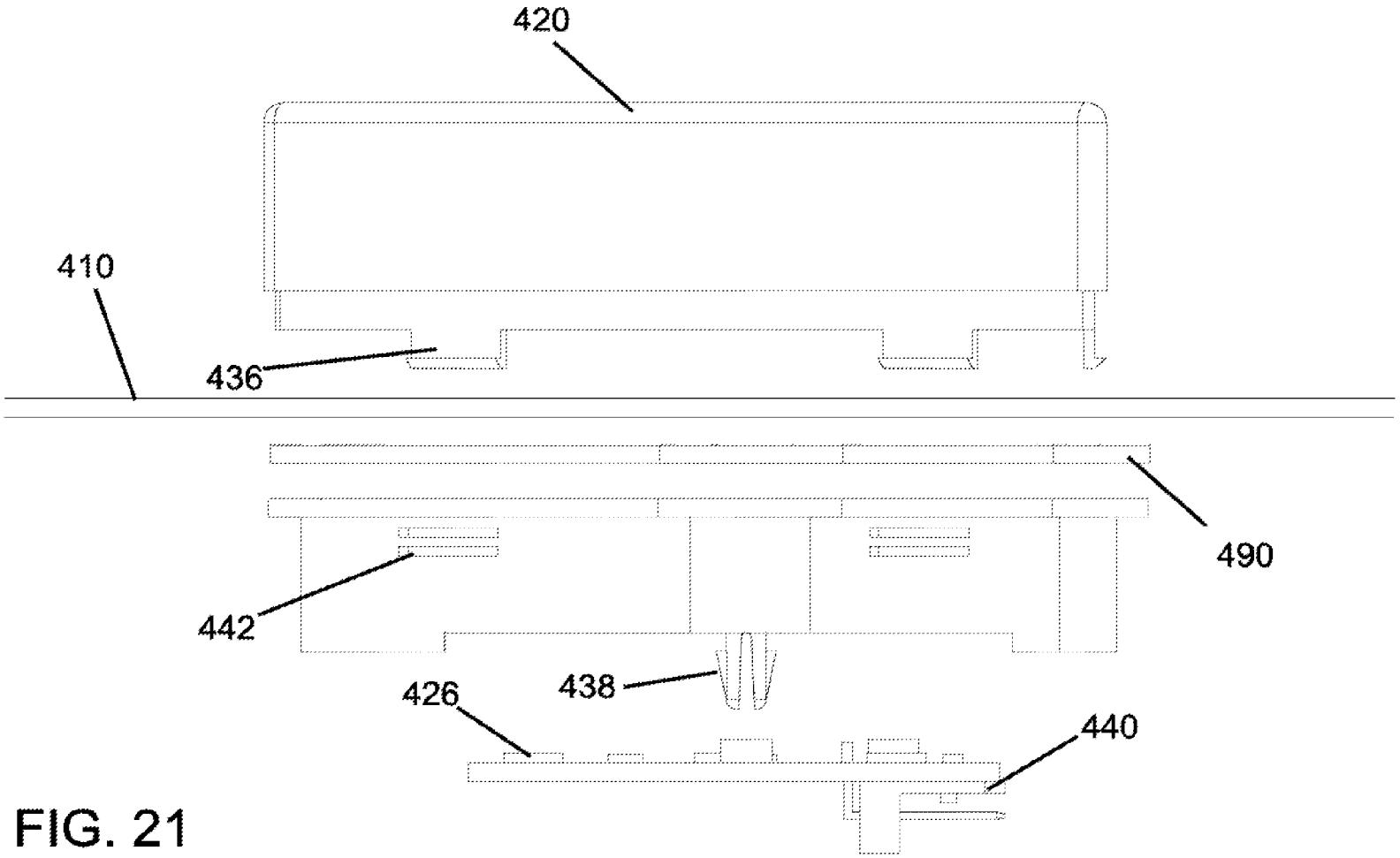
FIG. 21 depicts a side, exploded, elevation view of the elevator system of FIG. 17.

Foam layer (490) comprises a thin foam material that is placed between tray (424) and wall surface (410) as seen in FIGS. 20-21 and described above. Foam layer (490) has a shape that generally matches the footprint of tray (424). Foam layer (490) further comprises an adhesive material or may otherwise be coated in an adhesive such that tray (424) can essentially be adhered to wall surface (410). It will be appreciated that foam layer (490) is operable to adhere to various materials. Foam layer (490) may be attachable to wall surface (410) and/or tray (424) such that once attached foam layer (490) cannot easily be removed from wall surface (410) and/or tray (424), but if done can be readily replaced with a replacement foam layer (490). In other versions, foam layer (490) may comprise an adhesive material that permits tray (424) to be detached from wall surface (410) and reattached multiple times.

Figure 18:
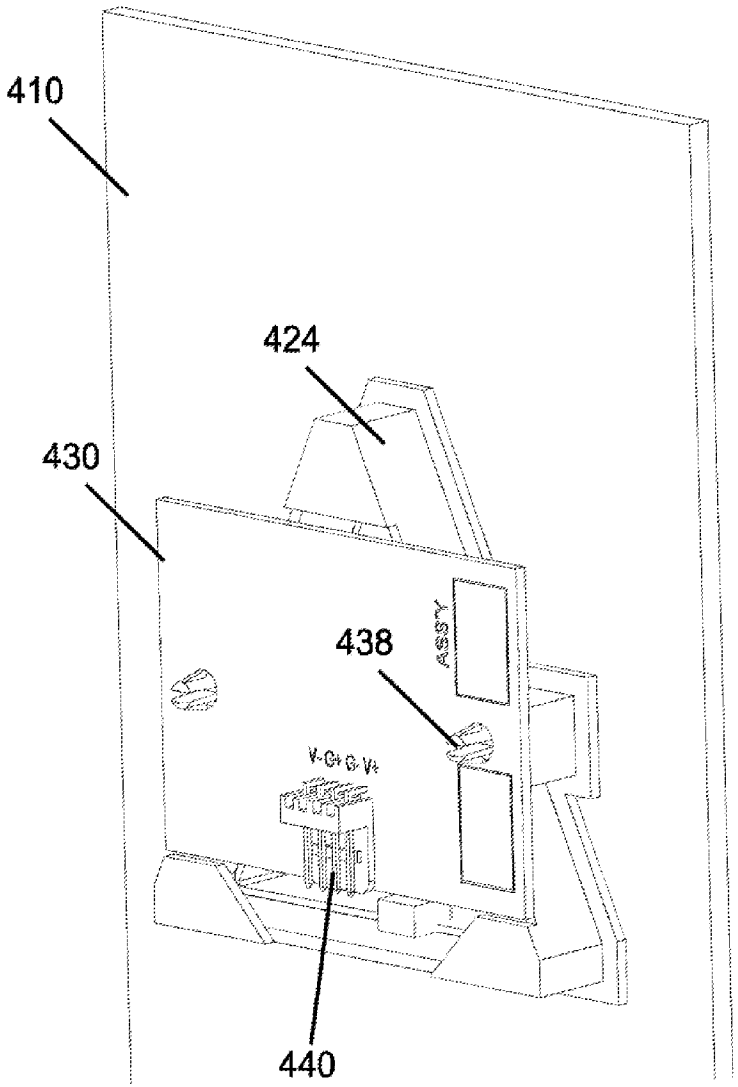
FIG. 18 depicts a rear, perspective view of the elevator lantern system of FIG. 17.

Control board (430) has a rectangular shape as can be seen in FIG. 18, but other suitable shapes may be used for control board (430). Control board (430) comprises a plurality of LEDs (426) operable to illuminate when instructed to by a control interface (440), which may be seen, in FIGS. 20-21. Control interface (440) is operable to communicate with an elevator control such that the elevator control can instruct control interface (440) whether LEDs (426) should turn on or off. Control board (430) may include any other suitable components to enable elevator lantern system (400) to operate. For instance, control board (430) may also include backup batteries, diagnostic controls, or any other suitable components.

Generally speaking, control board (430) may be attached to tray (424) by board tabs (438), which may be engaged by pressing control board (430) into board tabs (438) as described above. Tray (424) may be adhered to foam layer (490), which is adhered to wall surface (410). Lens (420) may be snapped into tray (424) through wall surface (410) such that lens clips (436) couple with lens notches (442). In the event that a user needs to access control board (430) or other components, lens (420) may be snapped out by de-coupling lens clips (436) and lens notches (442). In the present example, this can be aided by resilient properties of lens (420) that allow a user to squeeze the sides of lens (420) to promote disengagement of lens clips (436) from lens notches (442).

V. Exemplary Elevator Lantern with Ratcheting Assembly

Figure 22:
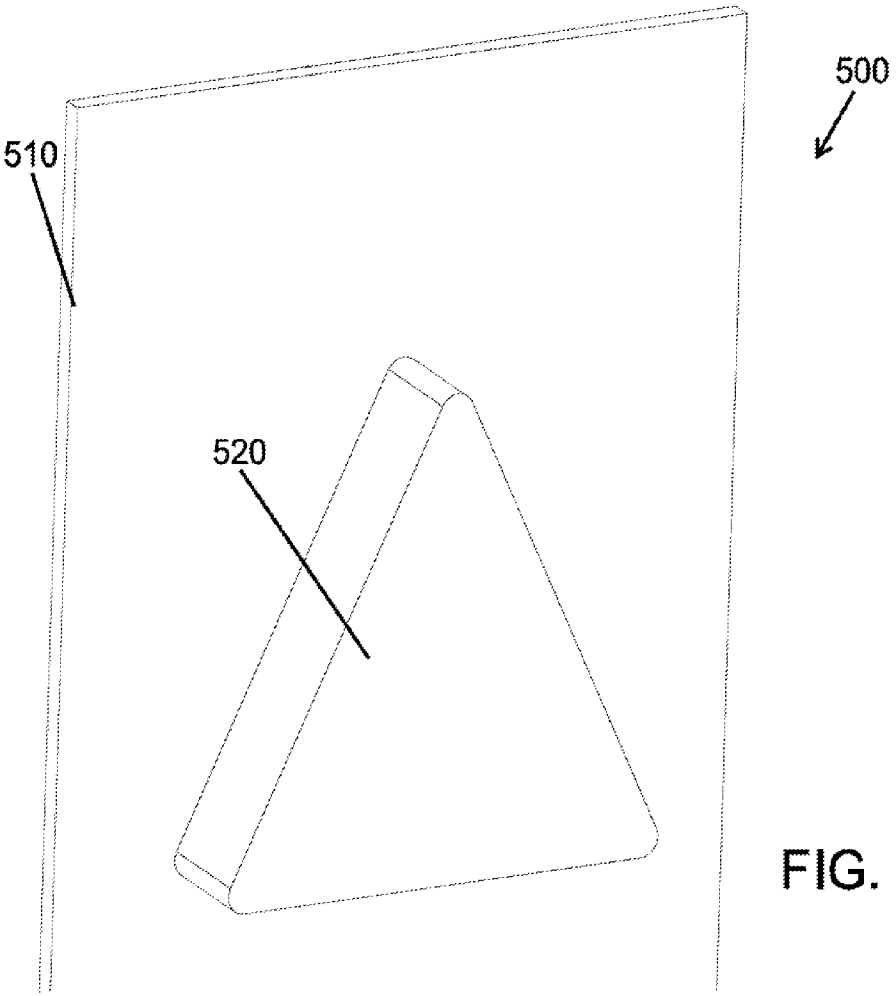
FIG. 22 depicts a perspective view of an alternative exemplary elevator lantern system with a ratcheting assembly or mechanism.
Figure 23:
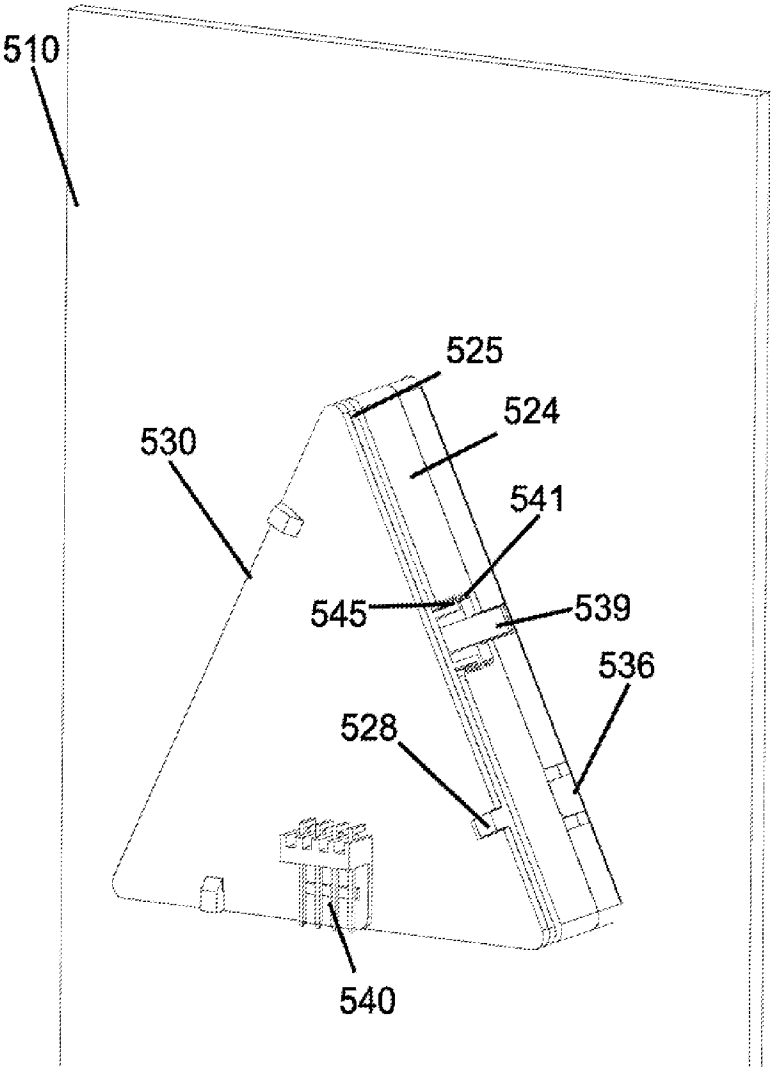
FIG. 23 depicts a rear, perspective view of the elevator lantern system of FIG. 22.

FIG. 22 shows yet another exemplary version of an exemplary elevator lantern system (500) comprising a wall surface (510) and a lens (520). Turning to FIG. 23, elevator lantern system (500) further comprises a control board (530), receiving tray (524), and an inserting tray (525).

Wall surface (510) includes a triangular opening (514) shaped to receive lens (520). Wall surface (510) may be constructed of any suitable metal, plastic, drywall, or other material operable to support lens (520) and tray (524) inserted into triangular opening (514). While the exemplary version shows opening (514) having a triangular shape (514) other suitable shapes may be used. For instance, a circular, elliptical, rectangular, arrow-shape, or any other suitable shape may be used.

Figure 26:
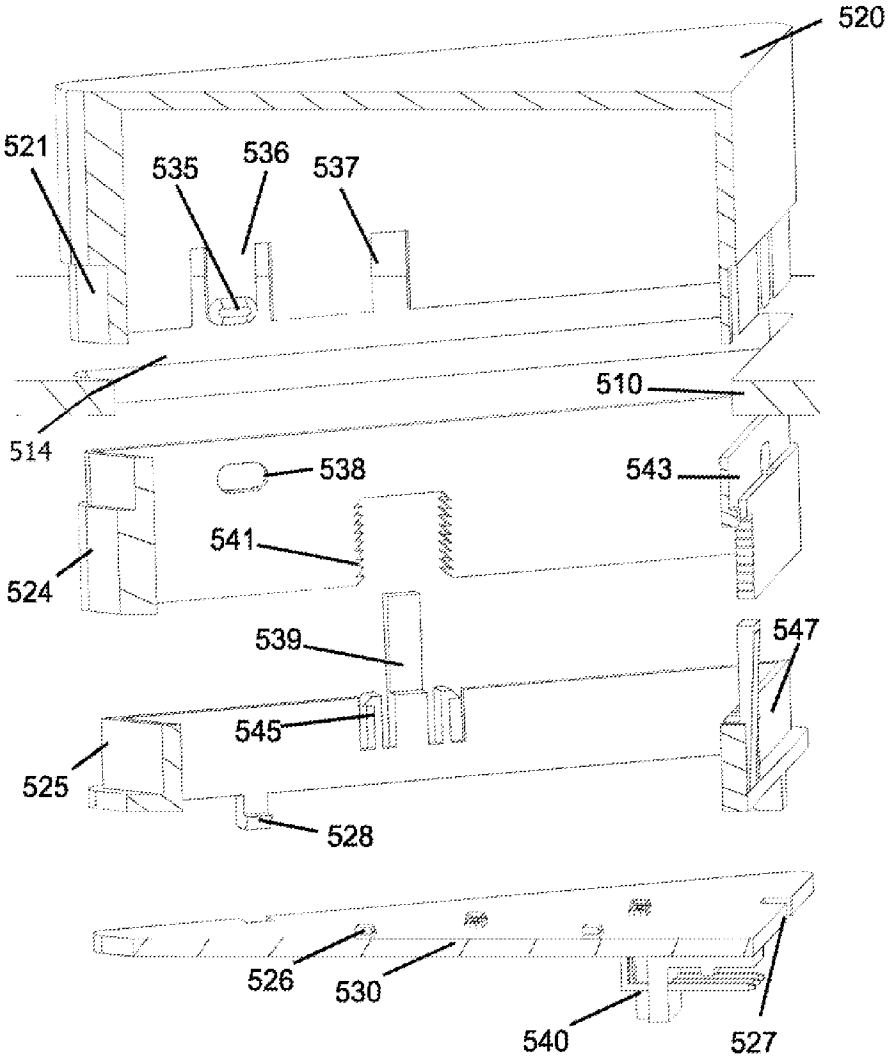
FIG. 26 depicts a perspective, exploded, cross sectional view of the elevator lantern system of FIG. 22 taken along line A-A shown in FIG. 25.

Lens (520) has a triangular shape operable to fit into opening (514). Lens (520) is constructed of a translucent or semi-translucent material such that a light within lens (520) can shine through lens (520). Lens (520) comprises lens tabs (536) and lens slit (537). Lens tabs (536) extend from lens (520) towards receiving tray (524) and as seen in FIG. 26 define a detent (535) operable to engage tray (524). In particular, detent (535) is operable to couple with a tray slot (538), which will be discussed in more detail below. Lens slit (537) is operable to engage a tray tab (539), which will be discussed in further detail below. Lens slit (537) has a generally rectangular shape extending towards receiving tray (524). It will be appreciated that other suitable shapes for lens slit (537) may also be used. For instance, lens slit (537) may have a rounded, circular, or any other suitable shape.

Lens (520) also includes a recessed lens portion (521) operable to complement the shape of opening 514 in wall surface (510). As a result, when lens (520) is placed within wall surface (510), recessed lens portion (521) actually enters opening (514) whereas the remainder of lens (520) is wide enough relative to opening (514) that the remainder of lens (520) cannot enter opening (514).

Receiving tray (524) also has a triangular shape able to complement opening (514) in wall surface (510). Receiving tray (524) includes a recessed region (543) operable to fit within recessed lens portion (521). Furthermore, receiving tray (524) comprises tray slot (538) and a set of ratcheting teeth (541). Tray slot (538) has an elongated elliptical shape operable to receive detent (535). It will be understood that tray slot (538) may have any suitable shape as would be apparent to one of ordinary skill in the art in view of the teachings herein. For instance, tray slot (538) may have a straight rectangular shape, a circular shape, or any other suitable shape that complements the shape of detent (535). Ratcheting teeth (541) comprise a plurality of linearly arranged teeth operable to engage ratchet tabs (545), which will be discussed in further detail below. Ratcheting teeth (541) extend substantially along the width of receiving tray (524).

Inserting tray (525) is operable to engage receiving tray (524). Inserting tray (525) comprises a recessed region (544), ratcheting tabs (545), and tray tab (539). Inserting tray (525) has a triangular shape operable to complement receiving tray (524). Recessed region (544) is shaped such that recessed region (544) can be inserted into receiving tray (524). Tray tab (539) has a flat end such that when inserting tray (525)

engages receiving tray (524) and receiving tray (524) is placed within opening (514) of wall surface (510), tray tab (539) abuts wall surface (510). Ratcheting tabs (545) are operable to couple with ratcheting teeth (541) via a ratcheting motion and are arranged in a dual column configuration with a dual column of ratcheting teeth (541). As a result, as inserting tray (525) is pressed against receiving tray (524), ratcheting tabs (545) incrementally advance along ratcheting teeth (541). As ratcheting tabs (545) advance, it will be understood that ratcheting tabs (545) and ratcheting teeth (541) produce a haptic and/or audible click such that the user may receive confirmation that ratcheting tabs (545) are advancing along ratcheting teeth (541). In some versions, ratcheting tabs (545) couple with ratcheting teeth (541) in a sufficiently loose manner such that when sufficient manual force is applied to inserting tray (525), ratcheting tabs (545) can be decoupled from ratcheting teeth (541) allowing the user to separate receiving tray (524) from inserting tray (525). In some other versions, ratcheting tabs (545) are engaged with ratcheting teeth (541) such that to decouple these components, ratcheting tabs (545) are moved inward away from ratcheting teeth (541) by exerting a force on ratcheting tabs (545) that is generally perpendicular to ratcheting teeth (541), and then pulling inserting try (525) away from receiving tray (524).

Inserting tray (525) further comprises board tabs (528) operable to couple with board notches (527) and further operable to retain control board (530) against inserting tray (525). While the exemplary version shows three board tabs (528) used, it will be understood that any suitable number of board tabs (528) may be used as would be apparent to one of ordinary skill in the art in view of the teachings herein.

Control board (530) has a triangular shape and comprises a plurality of LEDs (526). Control board (530) further comprises a control interface (540) and board notches (527). LEDs (526) may include LED lights as shown in the exemplary version, but may also include any suitable light including fluorescents, compact fluorescents, incandescent, lasers, or any other suitable light source. Furthermore, while the exemplary version shows a plurality of LEDs (526), a single LED (526) or other suitable light source may be used as would be apparent to one of ordinary skill in the art in view of the teachings herein.

LEDs (526) are in communication with control interface (540). Control interface (540) is also in communication with an elevator control operable to provide instructions to control interface (540) to deliver to LEDs (526) regarding whether to turn on or off LEDs (526). As mentioned earlier with regard to other versions, LEDs (526) may be configured to illuminate for a variety of reasons including signaling that an elevator car is approaching a landing zone, signaling the direction that an incoming elevator car will be leaving, signaling diagnostic results, signaling startup routines for elevator lantern system (500), or providing any other suitable signal. While control interface (540) is positioned on the rear of control board (530), it will be understood that control interface (540) may be placed in any suitable position on control interface (540).

Board notches (527) include a rectangular shaped notch operable to couple with board tabs (528). Board notches (527) are further aligned with board tabs (528). Control board (530) may be pressed against board notches (527) of inserting tray (525) such that board tabs (528) snap into board notches (527), thereby coupling control board (530) and inserting tray (525).

Figure 24:
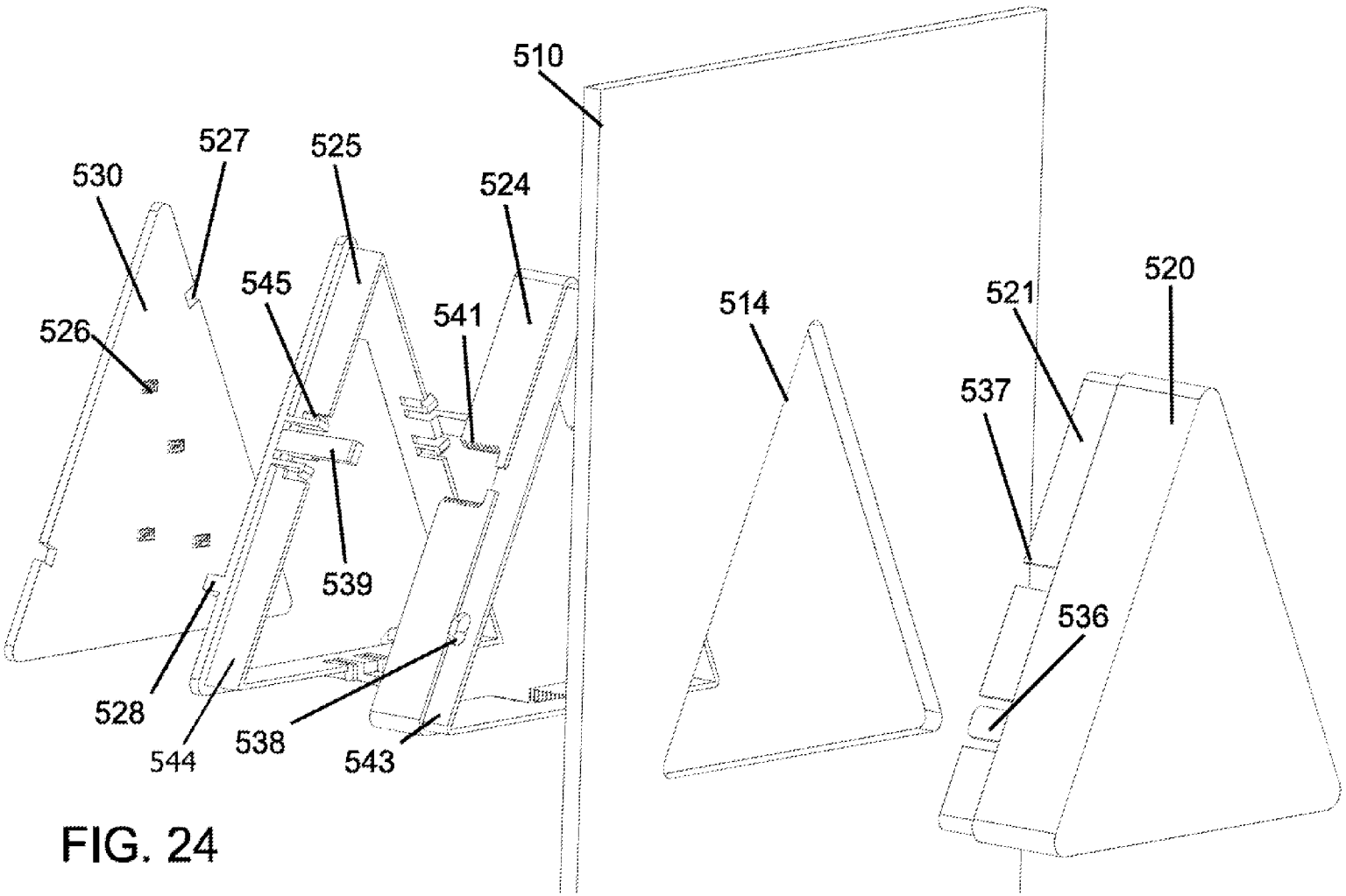
FIG. 24 depicts a perspective, exploded view of the elevator lantern system of FIG. 22.
Figure 25:
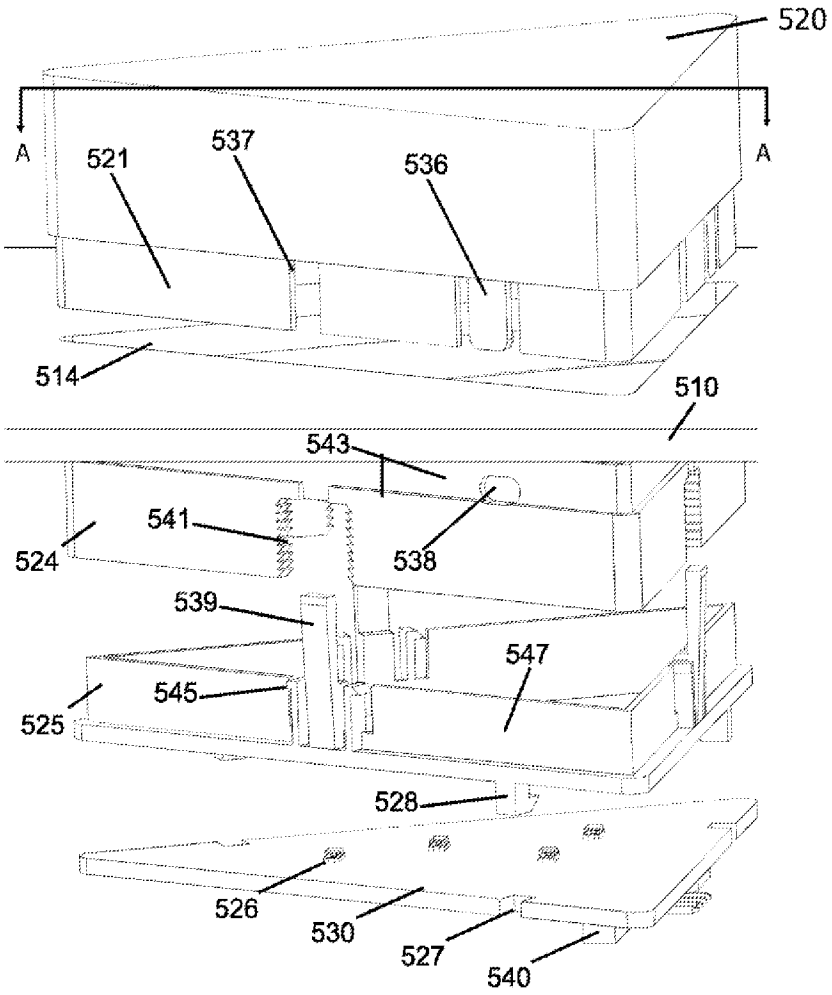
FIG. 25 depicts an enlarged, perspective, exploded view of the elevator lantern system of FIG. 22.

FIG. 24 shows generally that receiving tray (524) may be inserted into opening (514) of wall surface (510). Thereafter, inserting tray (525) may be placed into receiving tray (524), and control board (530) is clipped onto inserting tray (525) as seen in FIG. 23. Lens (520) may be inserted through opening (514) such that lens (520) clips onto receiving tray (524). In the event that a user needs to access control board (530) or any other suitable component, in some versions the user can remove lens (520) by pulling on lens (520) with sufficient force. In such versions, the rounded nature of detent (535) allows detent (535) to decouple from tray slot (538) when sufficient force is applied. Still in other versions, users may access lantern system (500) from the side opposite lens (520), through some other access means and location that will be understood by those of ordinary skill in the art in view of the teachings herein.

VI. Exemplary Elevator Lantern with Mounted Front Access

Figure 27:
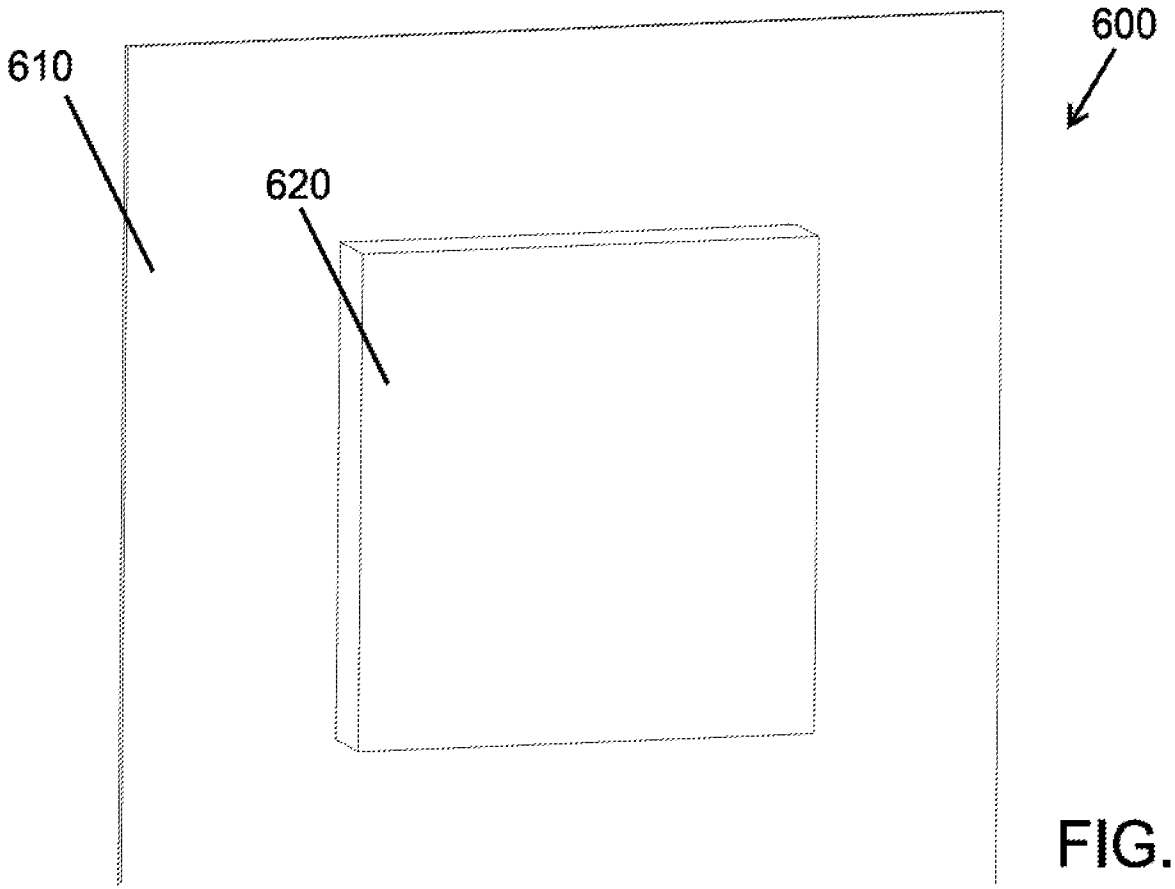
FIG. 27 depicts a perspective view of an alternative exemplary elevator lantern system with a mounting bracket.

It will be understood that in some versions, it may be desirable to have an elevator lantern system mounted directly onto an existing structure. FIG. 27 shows an exemplary elevator lantern system (600) operable to be mounted to a structure using a mounting bracket as will be described in further detail below.

Figure 28:
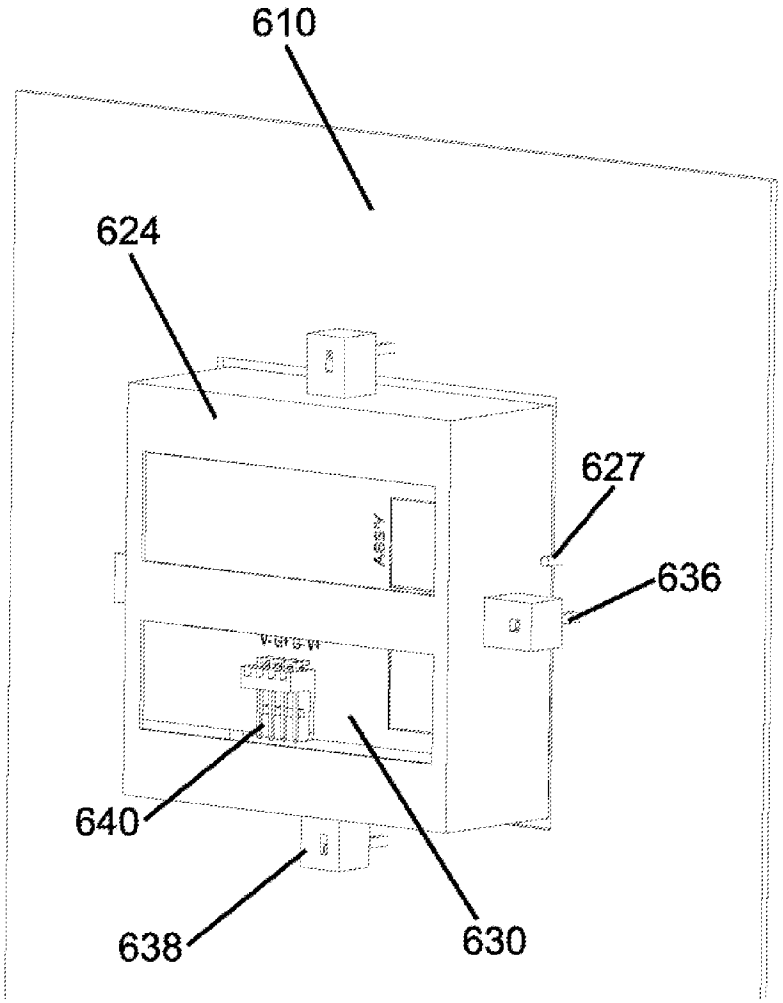
FIG. 28 depicts a rear, perspective view of the elevator lantern system of FIG. 27.

Elevator lantern system (600) comprises a lens (620) and a wall surface (610). FIG. 28 shows that elevator lantern system (600) further comprises a tray (624), control board (630), and a mounting bracket (625).

Figure 29:
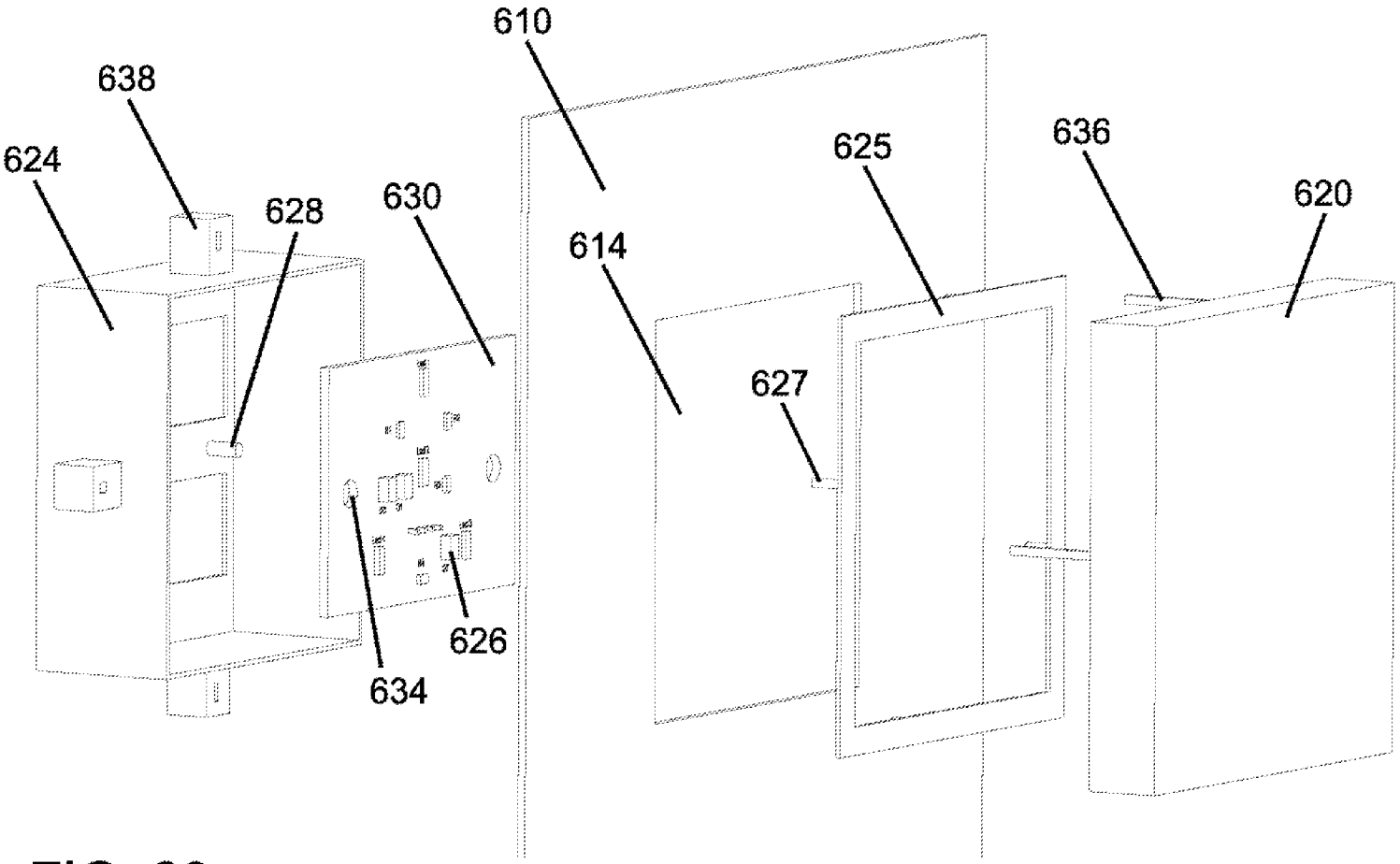
FIG. 29 depicts a perspective, exploded view of the elevator lantern system of FIG. 27.
Figure 30:
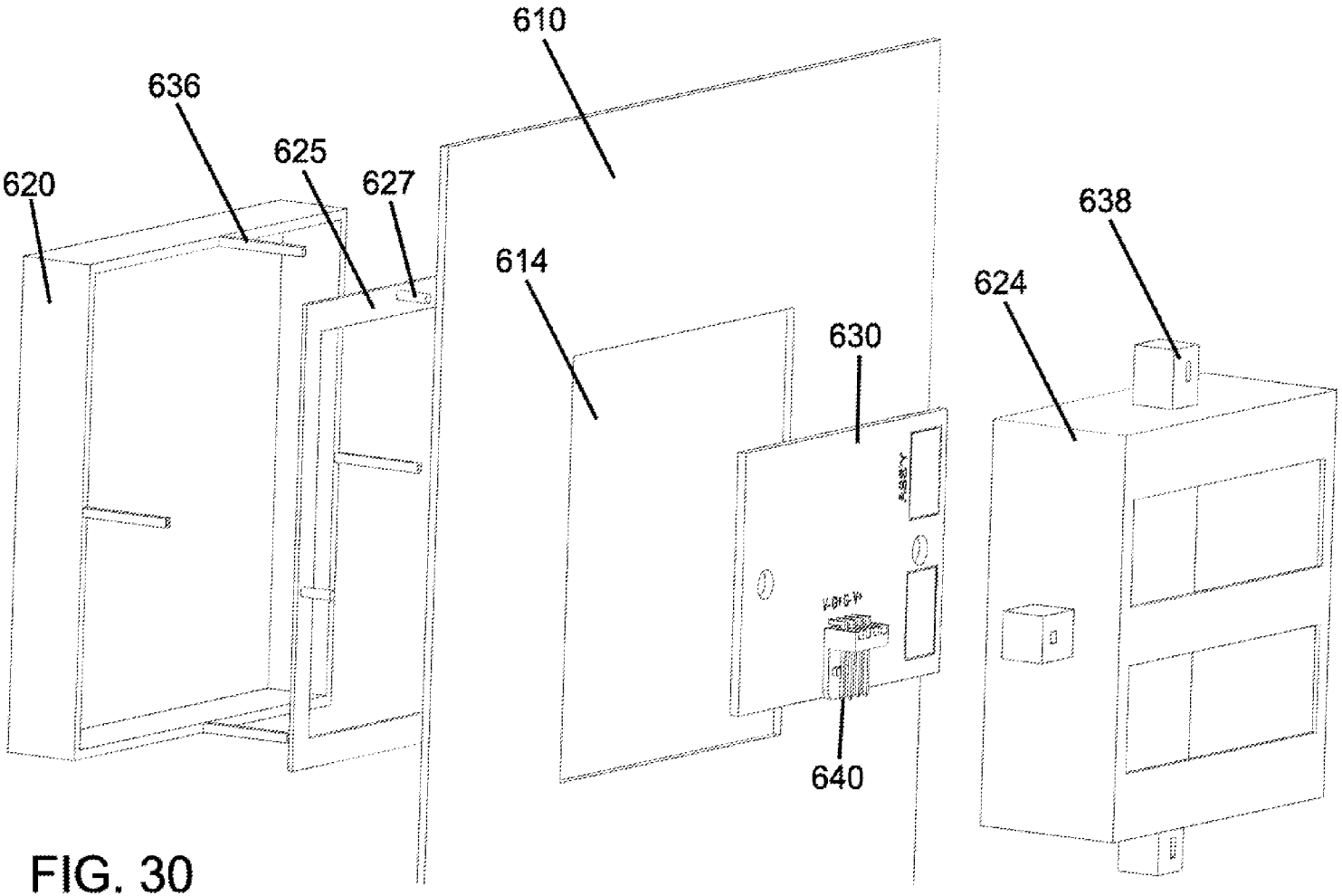
FIG. 30 depicts a rear, perspective, exploded view of the elevator lantern system of FIG. 27.

Wall surface (610) shown in FIGS. 29-30 has a square-shaped opening (614). It will be appreciated that while opening (614) has a square shape, opening (614) may have any suitable shape that complements lens (620). Wall surface (610) is made of a material such that lens posts (636) of lens (620) can penetrate wall surface (610) to install lens (620) onto wall surface (610). Alternatively, wall surface (610) may be drilled or pre-drilled to provide mounting holes for lens (620) to be installed on wall surface (610).

Lens (620) comprises lens posts (636), which are operable to couple lens (620) with tray (624). Lens (620) has a square-like shape and is made of a translucent or semi-translucent material such that a light within lens (620) is operable to illuminate through lens (620). It will be understood that lens (620) may have any suitable shape as would be apparent to one of ordinary skill in the art. Lens posts (636) have an elongated post shape. Four lens posts (636) are used with one lens post (636) along each side of lens (620) in the exemplary version. But it will be appreciated that any suitable number of lens posts (636) may be used as would be apparent to one of ordinary skill in the art.

Mounting bracket (625) has a square frame shape slightly larger than opening (614) of wall surface (610). It will be understood that mounting bracket (625) may have any suitable shape that complements opening (614). Mounting bracket (625) further comprises mounting posts (627) that extend from mounting bracket (625) toward wall surface (610). Mounting posts (627) are operable extend through wall surface (610). For instance, mounting bracket (625) could be hammered such that mounting posts (627) penetrate wall surface (610). In other versions, wall surface (610) could be drilled or pre-drilled to allow mounting posts (627) to extend through the drilled wall surface (610). Furthermore, mounting posts (627) may further be operable to extend through wall surface (610) into a framing structure or other support structure, e.g., a stud within a wall or any other suitable framing structure. It will be appreciated that other suitable methods for installing elevator lantern system (600) may be used as would be apparent to one of ordinary skill in the art.

Tray (624) has a cubic shape operable to hold control board (630). Tray (624) comprises board tabs (628) and lens notches (638). While the exemplary version shows tray (624) as having a square-like structure, it will be understood that any suitable shape may be used. Board tabs (628) comprise pegs or posts extending towards control board (630) as seen in FIG. 29. Board tabs (628) are operable to couple with control board openings (634). While the exemplary version shows board tabs (628) having a peg or post structure, it will be understood that other suitable structures may be used. For instance, instead of board tabs (628), clips, clasps, hooks, or any other suitable structure may be used to couple board tabs (628) to control board (630) as would be apparent to one of ordinary skill in the art.

Lens notches (638) have a cubic shape with an opening operable to receive lens posts (636). Lens notches (638) are aligned with lens posts (636) such that a user can press lens (620) against wall surface (610) and engage lens posts (636) and lens notches (638). In other versions, other suitable structures for coupling lens (620) and tray (624) may be used as would be apparent to one of ordinary skill in the art in view of the teachings herein.

Control board (630) includes control board openings (634), LEDs (626), and a control interface (640). Board openings (634) are circular shaped openings (634) operable to receive board tabs (628) as discussed above. It will be understood that while circular openings (634) are used, other suitable shapes for board openings (634) may be used as would be apparent to one of ordinary skill in the art. LEDs (626) include a plurality of LEDs (626) operable to illuminate lens (620). It will be appreciated that while the exemplary version includes LEDs (626), other structures operable illuminate lens (620) may be used as would be apparent to one of ordinary skill in the art. For instance, in some versions, an incandescent bulb, laser, fluorescent bulb, compact fluorescent bulb, or any other suitable light source may be used as would be apparent to one of ordinary skill in the art.

Control interface (640) seen in FIG. 30 is in communication with LEDs (626) such that control interface (640) can control whether LEDs (62) light on or turn off. Furthermore, control interface (640) is in communication with an elevator control system such that the elevator control system can send instructions to control interface (640). Furthermore, while in the exemplary version shows control interface (640) positioned on the rear of control board (630), other suitable positions may be used as would be apparent to one of ordinary skill in the art.

VII. Exemplary Plate Access Tool

Regarding the various elevator lantern systems described above, it will be appreciated that a variety of lenses are used, which may need to be removed for the user to access the internal components of the elevator lantern systems. Furthermore, various components are connected through tabs, notches, slits, and recesses that, in some instances or versions, may be difficult to detach using only the bare hands of a user.

Figure 31:
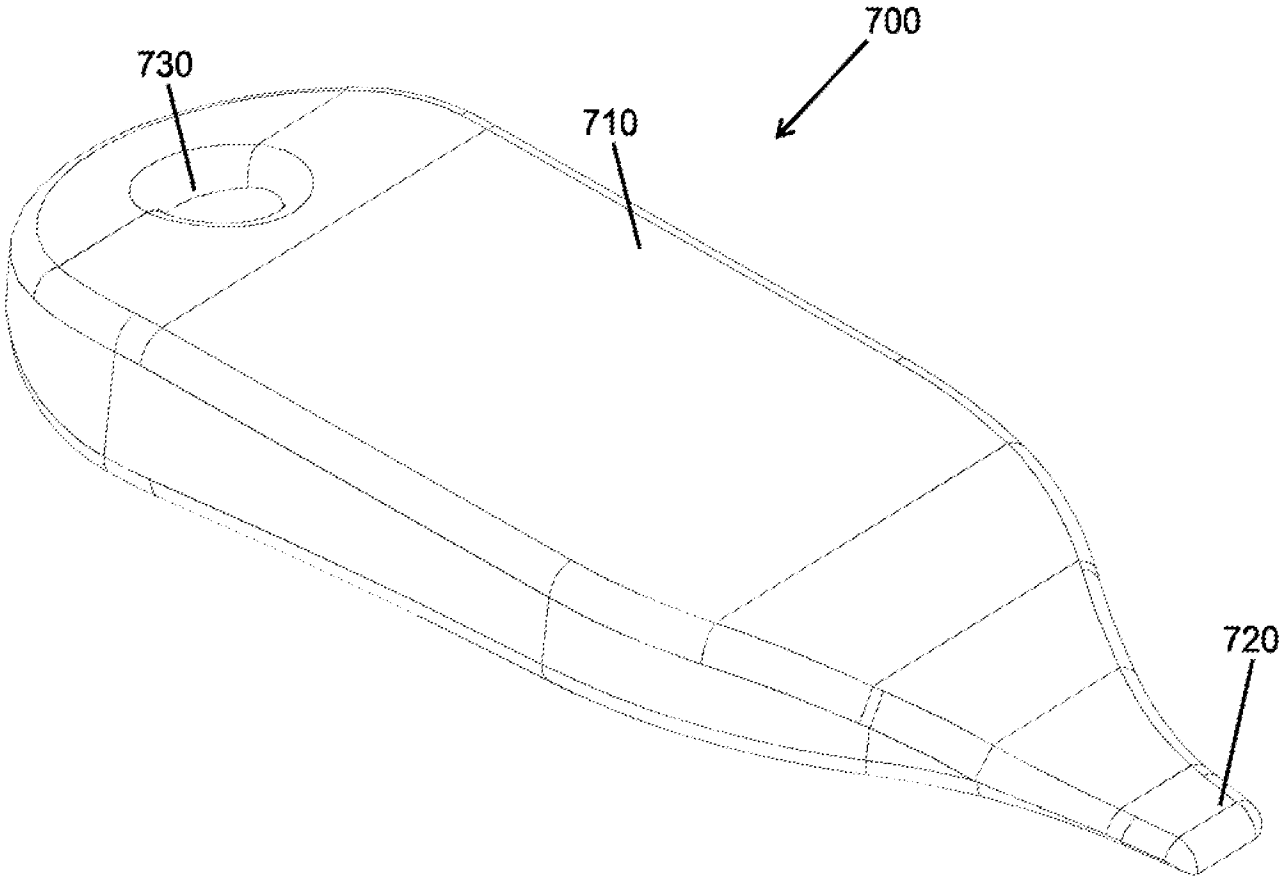
FIG. 31 depicts a perspective view of exemplary access tool.

FIG. 31 shows an exemplary access tool (700). Access tool (700) comprises a body (710), a tip (720), and defines an opening (730). Body (710) of the exemplary version has a generally rectangular shape with beveled edges such that body (710) may be easily grasped. It will be understood that body (710) may have any suitable shape. Body (710) is constructed of a rigid plastic or metal such that the user may grip body (710) and apply sufficient force to tip (720).

Tip (720) comprises an angled tip operable to be wedged between a lens and a wall surface such as any of the lenses shown in FIGS. 1-30 such that the lens may be assisted off of wall surface, e.g., by prying lens from wall surface. In some versions, tip (720) may be used to flex various tabs within elevator lantern systems shown in FIGS. 1-30 in order to separate components.

Opening (730) is shaped as a circular opening and may be used to allow the user to attach access tool (700) to any suitable component. For instance, a string, wire, or portion of a keyring may be routed through opening (730) and subsequently connect access tool (700) to another object. In some versions, opening (730) may be omitted entirely.

Several versions of lanterns systems described and shown use snap-fit configurations for easy and efficient assembly and disassembly. Furthermore, several versions of lanterns systems described and shown are suitable for servicing the lantern systems from a location in front of the lens of the lantern system. In other words, instead of needing separate access to the area behind the lantern system where the control board is typically located, in several of the versions described and shown herein, the control board is accessible and in some versions even replaceable from the front side of the lantern system. Moreover, several versions of lantern systems described and shown allow assembly, disassembly, and reassembly without the need for tools or separate fasteners. In some versions an access tool can be used, but is not necessarily required, to facilitate decoupling certain snap-fit or connection features of the lantern systems.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An elevator lantern configured to selectively engage an opening in a surface, wherein the elevator lantern comprises:

(a) a lens, wherein the lens is positionable generally adjacent to a front side of the opening in the surface, wherein the lens is removable from the elevator lantern;

(b) a first tray, wherein the first tray is positionable with a first portion of the first tray extending rearward from the opening;

(c) a control board comprising at least one illuminating feature operable to illuminate the lens, wherein the control board is configured to be engaged with the first tray such that the control board is accessible when the lens is removed, wherein the control board is positionable within the first tray from the front side of the opening in the surface; and wherein the elevator lantern comprises a snap-fit, wherein the snap-fit permits assembly and disassembly of the elevator lantern without the use of separate fasteners.

2. The elevator lantern of claim 1, wherein the first tray is positionable from the front side of the opening in the surface, and wherein the first tray is positionable with a second portion of the first tray extending forward from the opening.

3. The elevator lantern of claim 1, wherein the snap-fit of the elevator lantern permits assembly and disassembly of the elevator lantern from the front side of the opening in the surface.

4. The elevator lantern of claim 1, wherein the lens selectively engages the first tray, wherein the engagement of the lens with the first tray covers the control board.

5. The elevator lantern of claim 1, wherein the first tray uses a snap-fit with the opening in the surface to secure the first tray within the opening, and wherein the lens uses a snap-fit with the first tray to secure the lens with the first tray.

6. The elevator lantern of claim 5, wherein the lens comprises at least one lens tab, wherein the first tray comprises at least one lens notch, wherein the at least one lens tab is operable to engage the at least one lens notch to make the snap-fit.

7. The elevator lantern of claim 1, wherein the control board uses a snap-fit with the first tray to secure the control board with the first tray.

8. The elevator lantern of claim 1, wherein the lens, the first tray, and the control board comprise corresponding shapes.

9. The elevator lantern of claim 8, wherein the lens, the first tray, and the control board comprise an arrow shape.

10. The elevator lantern of claim 1, wherein the first tray comprises a recess configured to engage a corresponding tab in the opening of the surface to secure the first tray with the surface.

11. The elevator lanterns of claim 10, wherein the tab comprises a resiliently biased material.

12. The elevator lantern of claim 1, further comprising a foam layer, wherein the foam layer is positionable between the first tray and the surface.

13. The elevator lanterns of claim 12, wherein the foam layer comprises an adhesive that allows the foam layer to fasten the first tray to the surface.

14. The elevator lantern of claim 1, further comprising a second tray, wherein the first tray is configured to selectively engage the second tray, and wherein a select one of the first tray and the second tray is configured to selectively engage the lens, and wherein the other select one of the first tray and the second tray is configured to selectively engage the control board.

15. The elevator lantern of claim 14, wherein the first tray and the second tray comprise a ratcheting assembly wherein a select one of the first tray and the second tray comprises teeth, and wherein the other select one of the first tray and the second tray comprises a tab, wherein the tab is configured to engage the teeth to couple the first tray with the second tray.

16. The elevator lantern of claim 14, wherein the select one of the first tray and the second tray configured to selectively engage the lens further comprises a tab extending towards and sized to abut the surface when the elevator lantern is assembled.

17. An elevator lantern configured to selectively engage an opening in a wall, wherein the elevator lantern comprises:

(a) a first tray comprising a first engaging feature that contacts a front side in the wall to inhibit the first tray from passing through the opening in the wall, and a second engaging feature that contacts a rear side in the wall to inhibit the first tray from passing through the opening in the wall;

(b) a lens connectable by snap-fitting with the first tray, wherein the lens is positionable generally adjacent to the front side of the opening in the wall, wherein the lens is removable from the first tray without the use of separate fasteners; and (c) a control board comprising at least one illuminating feature operable to illuminate the lens, wherein the control board is connectable by snap-fitting with the first tray such that the control board is accessible when the lens is removed and removable from the first tray without the use of separate fasteners.

18. The elevator lantern of claim 17, wherein the engaging feature comprises a lip that surrounds at least a portion of the opening in the wall.

19. A method of assembling an elevator lantern, wherein the method comprises the steps of:

(a) locating an opening in a wall surface for placement of the elevator lantern;

(b) inserting a tray partially through the opening, wherein the act of inserting the tray partially through the opening comprises snap-fitting the tray within the opening such that portions of the tray are on both sides of the opening;

(c) connecting a control board to a power supply;

(d) connecting the control board to the tray, wherein the act of connecting the control board to the tray comprises snap-fitting the control board to the tray; and (e) connecting a lens to the tray, wherein the act of connecting the lens to the tray comprises snap-fitting the lens to the tray.

* * * * *